US006074493A

United States Patent [19]

Nakagawa et al.

[11] Patent Number: 6,074,493

[45] Date of Patent: Jun. 13, 2000

[54] METHOD OF CONTINUOUSLY CARBURIZING METAL STRIP

[75] Inventors: Tsuguhiko Nakagawa; Koushi Kuramoto; Nobuaki Hanazono; Jun Morozumi, all of Kurashiki; Susumu Satoh; Susumu Okada, both of Chiba, all of Japan

[73] Assignee: Kawasaki Steel Corporation, Kobe, Japan

[21] Appl. No.: 08/713,189

[22] Filed: Sep. 12, 1996

Related U.S. Application Data

[63] Continuation of application No. 08/638,868, Apr. 29, 1996, abandoned, which is a continuation of application No. 08/244,991, Jun. 15, 1994, abandoned.

[51] Int. Cl.[7] ..... C23C 8/20; C21D 1/54

[52] U.S. Cl. ..... 148/216; 148/508

[58] Field of Search ..... 148/212, 215, 148/216, 225, 233, 508

[56] References Cited

U.S. PATENT DOCUMENTS

| | | | |
|---|---|---|---|
| 3,950,192 | 4/1976 | Golland et al. | 148/233 |
| 4,317,687 | 3/1982 | Kaspersma et al. | 148/216 |
| 4,322,255 | 3/1982 | Kostelitz | 148/216 |
| 5,192,485 | 3/1993 | Kuramoto et al. | 148/212 |

FOREIGN PATENT DOCUMENTS

| | | |
|---|---|---|
| 54-31976 | 10/1979 | Japan . |
| 58-144469 | 8/1983 | Japan . |
| 1-176065 | 7/1989 | Japan . |
| 3-199344 | 8/1991 | Japan . |
| 4-88126 | 3/1992 | Japan . |
| 4-198462 | 7/1992 | Japan . |
| 4-202648 | 7/1992 | Japan . |
| 4-202650 | 7/1992 | Japan . |

OTHER PUBLICATIONS

"Carburization of Iron In Co–$N_2$ Atmosphere", Hu–yun Ye, et al., Institute for Design, Ministry of Mechanical Industry, Dec. 1985); pp. 529–535.

International Search Report for PCT/JP93/01486 dated Jan. 11, 1994.

*Primary Examiner*—Scott Kastler

*Attorney, Agent, or Firm*—Staas & Halsey, LLP

[57] ABSTRACT

This invention aims at providing a method of continuously carburizing a metal strip, which is capable of providing industrially optimum carburization conditions while attaining non-soot-generating atmospheric data, desired carburization concentration distribution and desired carburization rate, in a case where a strip passed through a carburization furnace is carburized continuously in a surface reaction rate-governing area in which the carbon concentration in a superficial layer of the strip has not yet reached an equilibruim level with respect to the time. The method consist of carburization concentration distribution (S7), on the basis of the carburization conditions including given specification data for the steel plate, furnace temperature and composition of the atmospheric gas, outputting the concentration of the components of the atmospheric gas, feed and discharge rates and other carburization conditions when the set carburization rate and an actual carburization rate are equal (S8–S15), and correcting the set carburization rate when a difference between the set carburization rate and an actual carburization rate is large, and correcting the strip feed rate while correcting the composition of the atmospheric gas when a difference between the predetermined carburization rate and set carburization rate is large (S9).

33 Claims, 14 Drawing Sheets

FIG. 14

MODEL PREDICTED VALUE AND EXPERIMENTAL VALUE

| | | COMPOSITION (%) | | | DEW POINT (°C) |
|---|---|---|---|---|---|
| | | CO | $H_2$ | $CO_2$ | |
| CASE 1 | MODEL PREDICTED VALUE | 3.91 | 3.20 | 10.70 | 48.0 |
| | EXPERIMENTAL VALUE | 3.95 | 3.02 | 10.67 | 48.2 |
| CASE 2 | MODEL PREDICTED VALUE | 3.38 | 3.53 | 8.79 | 51.0 |
| | EXPERIMENTAL VALUE | 3.39 | 3.40 | 8.79 | 50.1 |

EXPERIMENTAL CONDITIONS
930°C
TREATMENT TEMPERATURE
930°C
$CO_2$ (100%$CO_2$) • • • 0.5-1.1 (NL/MIN)
$H_2$ (50% $H_2$) • • • 2.0-2.1 (NL/MIN)
$N_2$* (100% $N_2$) • • • 4.5-5.5 (NL/MIN)
* $N_2$ MEANS A LEAKAGE QUANTITY FROM SEALING

METHOD OF CONTINUOUSLY CARBURIZING METAL STRIP

This application is a continuation, of application Ser. No. 08/638,868, filed Apr. 29, 1996, now abandoned which is a continuation of application Ser. No. 08/244,991, filed Jun. 15, 1994, now abandoned.

TECHNICAL FIELD

The present invention relates to a continuous carburizing method in the case of continuously gas carburizing a metal strip. For example, in the case of continuously gas carburizing a strip consisting of extremely low carbon steel by plate-passing from an annealing furnace to a carburizing furnace, for the purpose of carburizing, with a desired carburizing quantity, the strip which is plate-passed at a plate-passing speed set under operation conditions other than a carburizing treatment, in a surface reaction-governing area before a carbon concentration in a surface layer of the strip reaches an equilibrium concentration between the strip and an atmospheric gas, and also for the purpose of obtaining a desired carburizing concentration distribution in the steel, the present invention is suitable to control an atmospheric gas composition, a composition gas concentration, a furnace temperature, a metal strip temperature, a plate-passing speed, etc., as atmospheric factors which do no generate sooting.

BACKGROUND TECHNIQUE

For example, in metal secondary working industries such as automobile industries, the compatibility of higher workability with strength is required with respect to a metal plate which is the object of working. Specifically, in the above-mentioned automobile industries, from the need to make the body light in weight in order to seek low fuel consumption in view of the earth environmental problem which has been raised recently, there is a requirement of a steel plate which has a higher strength while maintaining a deep drawing property provided heretofore.

As evaluation indices for such a metal plate, for example, an elongation index, a deep drawing property, an aging index, a strength, a secondary working brittleness, a baking hardening property, a spot welding property, etc., may be considered. Thus, when the deep drawing property is evaluated by a Lankford value (hereinafter referred to as r value: metal plate width strain/plate thickness strain) by placing great importance on the deep drawing property, it is known that the reduction of the amount of carbon (hereinafter referred to as C) in the steel is most advantageous, and in addition, by this low carbonization, the elengation index (EI) and the cold-slow-aging index (AI: the lower the AI, the better) are also improved. However, on the other hand, when the amount of C in the steel decreases, most of the other evaluation indices are deteriorated. For example, since the structure strength is lowered due to reduction of precipitation, a tensile strength (ST) is decreased, and since the grain boundary strength is lowered, the secondary working brittleness is deteriorated, and since the amount of solid solution C is reduced, the baking hardening property is deteriorated. Furthermore, when the amount of C in the steel is equal to or lower than 50 ppm, the grain growth rate is promoted by heating of welding, and due to the grain coarsening in a heat affected zone (HAZ), the spot welding property is deteriorated.

The present applicant developed a continuous annealing and carburizing facility as described in Japanese Patent Laid-Open Publication Hei No. 4-88126 as shown in FIG. 2 in order to improve the above-mentioned tensile strength, secondary working brittleness, BH property, and spot welding property by making the solid solution C exist in a surface layer portion by a continuous carburizing treatment, subsequent to a continuous annealing treatment of a metal strip consisting of extremely low carbon steel as shown in FIG. 1 wherein the above-mentioned elongation index, deep drawing property, and cold-slow-aging index are obtained by recrystallizing and annealing.

In this continuous annealing and carburizing facility, after performing a predetermined recrystallizing and annealing with respect to a metal strip (strip A) in a preheating region 1 and a heating region 2, or a uniformly heating region 3, a carburizing treatment is performed in a carburizing region 4 by controlling a metal strip temperature, atmospheric factors, a transportation speed (in-turnace time) and cooling conditions, so that it is possible to continuously manufacture the metal strip having desired values (form) of a surface carburizing depth and a concentration distribution while satisfying material characteristic specifications of the metal strip.

On the other hand, as the method for controlling the distribution form of the surface carburizing depth and the concentration distribution of the surface layer portion of the metal strip, a method is described in Japanese Patent Publication No. 54-31976. In this control method of the carburizing depth and the concentration distribution, a carburizing gas is jetted and introduced at a predetermined flow rate in a carburizing period in order to infiltrate carbon into the surface layer portion of the metal strip, and in a diffusion period following to the carburizing period, under a sufficiently reduced pressure with the carburizing gas exhausted, the infiltrated carbon is diffused to the surface layer portion of the metal strip. And the carburizing concentration distribution form consisting of the carburizing depth and the carburizing concentration is controlled by controlling time periods of the carburizing period and the diffusion period. In this control method of the carburizing depth and the carburizing concentration, it is possible to prevent non-uniform carburizing which is apt to occur in a gas jet carburizing which requires in particular, a thin carburized layer (carburized case).

However, in setting various conditions of such a continuous carburizing and annealing facility, it was found that the following problems are involved.

(1) As regards the carburizing rate, it is known from a report by Yo et al. (YO kuun, HARUYAMA shiro et al.: Japan Metallic Society Journal 49 (1985) 7,529) that as shown in FIG. 3, when the amount of C in the metal surface layer portion is large to some extent and the carburizing time is long, since the rate of carburizing is proportional to the rate of diffusion of C into the metal structure after the C concentration reaches an equilibrium concentration between the strip and an atmospheric gas, the rate is normally proportional to a square root of time, and this time carburizing gain area is called as a diffusion-governing area. On the other hand, when the amount of C in the metal surface layer portion is very small and the carburizing time is very short, since the C concentration in the surface layer portion does not reach the equilibrium concentration, the rate of carburizing is proportional to the rate of reaction of the carbon directly on the metal surface layer portion, and this time carburizing gain area is called as a surface reaction-governing area.

Accordingly, for example, when the carburizing conditions for a metal strip are obtained from specifications (Japanese Patent Laid-Open Publication Hei No. 3-199344, etc.) of the metal which is the object of improvement in the anti-secondary working brittleness, since the carburizing concentration and the carburizing depth are very small, in this case it is necessary to perform the carburizing treatment in the surface reaction-governing area, and it was found that the carburizing quantity into the metal strip cannot be controlled by carbon potential (C potential) control by a so-called conventional $CO/CO_2$, etc., control in which it is considered that the metal strip surface layer portion is always in an equilibrium state with carburizing capability possessed by the atmospheric gas.

(2) Furthermore, generally, the atmospheric gas composition in the carburizing conditions can be obtained by chemical equilibrium. However, in conventional solutions, all the reactions conceivable in a gaseus phase system are listed, and a gas composition is obtained by solving non-linear simultaneous equations from these equilibrium relations of individual reactions. However, it is very difficult to obtain a correct limit of sooting generation from reaction equations in the gaseus phase system.

(3) Furthermore, as to the surface reaction rate mentioned above, there is the report by Yo et al. as described above, however, in this report, the carburizing rate of only CO gas is discussed, and it is impossible to apply to an actual situation of continuous carburizing operation which involves complicated composition.

In this respect, in the continuous annealing and carburizing facility as shown in FIG. 2, since it is necessary to perform a predetermined annealing treatment of the metal strip in the heating zone 2 and/or the uniformly heating zone 3, and to perform a predetermined carburizing treatment in the carburizing zone 4, and to perform a predetermined cooling treatment in each of the cooling zones 5 and 6, it is required to perform temperature (hereinafter described also as plate temperature) control of the metal strip in respective heat treatment zones, for example, by controlling a furnace temperature. In each furnace which constitutes each heat treatment zone, the plate temperature control is performed primarily by heat transfer, however, at the same time, upper and lower limits of the furnace inside temperature (hereinafter described also as furnace temperature) itself are present according to capability calculation of each furnace. For example, in the heating furnace in the heating zone and in the uniformly heating furnace in the uniformly heating zone, upper limit values of the furnace temperature are set from the capability of the furnaces, and an in-furnace time (i.e., it is also heating time or uniformly heating time) of the strip which satisfies the upper and lower limit values is set from heat balance which takes into consideration the heat transfer coefficients among a radiant tube, a furnace wall, a hearth roll, etc., and as a result, a plate-passing speed to satisfy the in-furnace time is set. Also, in the cooling furnace in each cooling zone, a heat transfer coefficient or the like of cooling gas jet is employed as the above-mentioned heat transfer coefficient.

On the other hand, in such a continuous annealing and carburizing facility, various operation conditions are mixed in which, the operation condition is changed at a nonstationary portion, for example, a joint portion of coils, or the like, and thus, in order to satisfy these conditions, it is not seldom to control a plate-passing speed having the most fast response speed. However, no concrete means has not yet been proposed for setting various carburizing conditions in the carburizing furnace with respect to the plate-passing speed which is set from various operating conditions including the plate temperature control in the above-mentioned continuous annealing and carburizing, and it is urgently desired to provide a means for controlling the physical properties and the temperature within the carburizing furnace to achieve the carburizing quantity to meet specification factors required for the steel plate as described above, in particular, under the conditions wherein the plate-passing speed is set.

In order to eliminate the restriction to the plate-passing speed, it may be considered to interpose a louver between respective heat treatment zones. However, it is practically difficult in view of actual problems to install the louver which needs large installation space in the continuous annealing facility which originally requires very large installation space, and in the continuous annealing and carburizing facility which is the continuous annealing facility added with the continuous carburizing facility.

Furthermore, there is a trend that more fine conditions are required as the specification factors of the above-mentioned carburized thin steel plate, and in order to meet such specification factors, it becomes necessary to manage and control the carburizing concentration distribution form of the metal strip surface layer portion, that is, to control even a profile in a depth direction of the carburizing concentration of the surface layer portion. For example, in the steel plate used for vehicles and electrical equipment, in order to perform baking hardening after press work, such characteristics are required in which at the time of press work, the forming property is high by exhibiting the elongation index EI and the deep drawing property r value, and at the time of baking hardening, the strength is improved by exhibiting the baking hardening property BH. At the same time, for these steel plates, the cold-slow-aging index (low AI) which enables to maintain the forming property until the time of performing the press work is required. Accordingly, it is necessary that these steel plates are cold-slow-aging index provided high baking hardening type steel plates (low AI-high BH steel plates) having the deep drawing property. When considering the profile of carburizing concentration in the steel, that is, the distribution state which is required in the case of obtaining the steel plate by the continuous annealing and carburizing of an extremely low carbon steel, it is necessary to increase the carbon concentration in the surface layer to a great extent and to form an optimum C gradient while maintaining the carbon concentration in the inner layer portion in a depth direction of the steel plate to that of the extremely low carbon steel. However, in the control method of the carburizing depth and the distribution form of the carburizing concentration described in the above-mentioned Japanese Patent Publication No. 54-31967, such a carburizing concentration profile is not taken into consideration, and it is impossible to apply this control method itself to the control of the carburizing concentration profile.

DISCLOSURE OF THE INVENTION

The present invention was developed in view of the various problems mentioned above, and it is an object to provide a control method which enables to obtain a desired carburizing quantity to a steel strip and to obtain a carburizing concentration distribution while preventing sooting even in the case wherein a plate-passing speed is restricted by operation conditions other than a carburizing treatment in particular, and the carburizing treatment performed at this plate-passing speed is carried out in the above-mentioned surface reaction-governing area.

The inventors of the present application studied hard the above-mentioned problems, and as a result, the present invention was developed based on the following knowledge. Specifically, in the problem of sooting which occurs in the form of free C in the carburizing furnace, even when each component quantity in a production system in the carburizing furnace is changed, the respective total quantity becomes constant when considering on the basis of each element level. And in the case of an isothermal, isotactic system, in a change which occurs naturally, Gibbs's free energy in the carburizing furnace is reduced, and in an equilibrium state in the system between the atmospheric gas and the metal strip, the Gibbs's free energy assumes a minimum value. Accordingly, since the equilibrium state in the atmosphere within the furnace can be obtained if an atmospheric gas composition in which the Gibbs's free energy assumes the minimum value is obtained, it is possible to reduce or prevent a reaction towards the generation of free carbon (soot). However, it was noted that it is impossible to calculate the true equilibrium state in the actual continuous carburizing, that is, the true sooting generation limit, without adding the restricting conditions in the incomings and outgoings of materials in which with respect of elements which are brought out by the metal strip from the atmospheric gas by reaction in the metal strip surface layer portion, element components which are brought into the original system are constant. Accordingly, in considering the actual incommings and outgoings of materials, not only the atmospheric gas composition but also the supply and discharge flow rate of atmospheric gas, plate-passing speed of the metal strip, furnace temperature, plate thickness, plate width, etc., must be considered.

Thus, in the continuous carburizing method of metal strip in the present invention, in controlling the carburizing atmospheric factors which include carbon and oxygen and nitrogen, or carbon and oxygen and hydrogen and nitrogen, and which do not generate sooting, the atmospheric gas composition and/or furnace temperature is calculated on the basis of a thermodynamics model formula which intends to obtain an equilibrium state of atmosphere in the furnace by obtaining a state wherein Gibbs's free energy of the whole atmosphere in the furnace becomes minimum, by taking into consideration the incomings and outgoings of materials of each element level in the actual continuous carburizing in the carburizing furnace. By virtue of this, as compared with the case where the atmospheric gas composition and/or furnace temperature is calculated from an equilibrium state obtained merely from a supplied gas composition and furnace temperature without taking into consideration the incomings and outgoings of materials of each element level in the furnace, it is possible to enhance the potential of the atmospheric composition while preventing the generation of sooting. In other wards, it is possible to improve the actual operation capability in which the plate-passing speed is increased by increasing a CO concentration in the atmospheric gas. Furthermore, as the conditions for the above-mentioned atmospheric factors, the following conditions are set in accordance with actual industrial continuous carburizing operation in which the furnace temperature is 700 to 950° C., carbon monoxide concentration is $0\% < CO$ concentration $\leqq 22\%$, and hydrogen concentration $0\% \leqq H_2$ concentration $\leqq 30\%$ . In this respect, since nitrogen in the atmospheric gas composition may be considered to be an inactive gas for diluting the concentration of the atmospheric gas, an inactive gas similar to argon Ar or the like may be used.

Furthermore, in order to control the carburizing quantity into the metal strip in the surface reaction-governing area wherein the carbon concentration in the metal surface layer portion is equal to or less than the equilibrium concentration between the metal strip and the atmospheric gas, it was noted that it is only necessary, first, to obtain the carburizing quantity in this rate area, that is, the surface reaction rate, and then to time integrate this reaction rate. This time, that is, the carburizing time is determined by the plate-passing rate. Furthermore, during the study of this surface reaction rate, it was found that it is possible to control the reaction rate by controlling the composition of the gas which is included in a formula of carburizing reaction considered in the surface reaction between the metal strip and the atmospheric gas, and also a formula of deoxidization reaction. Also it was found that the most effective to this gas composition are carbon monoxide and hydrogen, and in the case where the supply and discharge flow rate of the atmospheric gas is small under a high temperature in particular, although the composition quantity is small, also carbon dioxide and $H_2O$ affect in the meaning of disturbing the carburizing reaction. Furthermore, it was proved by experiments that in these compositions, their partial pressures are control factors of the above-mentioned surface reaction rate. Furthermore, taking into consideration the dependency of a material reaction on a temperature, a control factor referred as a metal strip temperature is interposed in the coefficient of the surface reaction rate.

Accordingly, in the continuous carburizing method of metal strip in the present invention, in a carburizing condition area wherein the carburizing rate follows the surface reaction rate which is larger than a diffusion rate towards the inside from the metal strip surface layer portion, a temperature dependency coefficient relating to the surface reaction rate of carburizing is calculated from, for example, a predicting formula relating to a metal temperature in the carburizing furnace, and a surface reaction rate of the carburizing is calculated from this temperature dependency coefficient and from a predicting formula relating to the carbon monoxide partial pressure, or the carbon monoxide partial pressure and the hydrogen partial pressure, and further, a carburizing quantity into the metal strip can be calculated from this surface reaction rate on the basis of a predicting formula relating to the above-mentioned carburizing time. As a result, it is possible to obtain the carburizing quantity into the metal strip which satisfies the specification factors of the steel plate under the most efficient carburizing conditions by setting the carburizing quantity into the metal strip conversely from the specification factors required for the steel plate after carburizing, and by suitably setting parameters in accordance with the actual continuous carburizing by using as the parameters the control variables contained in each of the predicting formulas. Furthermore, in the case where the supply and discharge flow rate of the atmospheric gas under a high temperature is in particular small, it is possible to accurately control the carburizing quantity into the metal strip under the presence of $CO_2$ and $H_2O$ by adding the carbon dioxide partial pressure and the $H_2O$ partial pressure as the control variables, that is, parameters to, for example, the predicting formula of the surface reaction rate, in order to take into consideration the influence of disturbance to the carburizing reaction.

Furthermore, it is possible to reduce the concentrations of $CO_2$ and $H_2O$ in the atmospheric gas composition by increasing the supply flow rate of the atmospheric gas, and it is possible to increase by decreasing the supply flow rate of the atmospheric gas.

Here, when the surface reaction rate is time integrated, the actual carburizing time is used. This carburizing time is expressed in a simple calculation by carburizing time=in-furnace time=effective carburizing furnace/plate-passing speed. Thus, when the plate-passing speed is restricted by the operation conditions other than the carburizing treatment as described before, it is interpreted that the carburizing time which is set by this plate-passing speed is conversely fixed, and it was confirmed that a desired carburizing quantity can be controlled by controlling the other control factors. In the actual carburizing treatment, with respect to the correlation between the carburizing time and the plate-passing speed, it is only necessary to take into consideration the atmospheric gas composition and the temperature of the metal strip. In this case, when the restricted plate-passing speed has a certain range, in order to seek further accuracy of the control, it is also possible to add the carburizing time to the parameters of the above-mentioned prediction formulas.

Here, in the continuous carburizing method of metal strip in the present invention, for example, in order to perform necessary carburizing quantity control, even when the fields of the plate temperature control and the carburizing control are the same or different as in such cases where the heat treatment and the carburizing are simultaneously performed, and the carburizing is performed after the heat treatment by lowering the temperature to a certain extent, the same control can be performed by taking into consideration, for example, the time series aspect of the plate-passing speed.

On the other hand, it was noted whether the carburizing concentration at a predetermined depth of the metal strip surface layer portion can be obtained from a carbon diffusion model formula based on the so-called Fick's law which uses the carburizing time and the carburizing temperature as parameters, and this was proved by experiments. Accordingly, in the continuous carburizing method of metal strip, it is possible to set the carburizing time and the metal strip temperature required to obtain a carburizing concentration at each depth position by applying a desired carburizing concentration distribution to this carbon diffusion model formula. Furthermore, in the low AI high BH steel plate and the like described previously, the desired carburizing concentration distribution form has a higher carburizing concentration at a portion nearer to the surface of the metal strip, that is, a shallower portion of the surface layer portion, and has a lower carburizing concentration at a portion remoter from the surface of the metal strip, that is, a deeper portion from the surface layer portion. However, it was found that when the carburizing concentration distribution conditions of the metal strip are set from the specification factors required for the above-mentioned carburizing thin steel plate, it is only necessary to control a carburizing concentration distribution at a depth of 10 to 250 $\mu$m from the metal strip surface. On the other hand, the carburizing quantity is also set by integrating this carburizing concentration distribution in a depth direction. Furthermore, in the case where there is an influence of decarburization in the cooling process on this carburizing concentration distribution form, a maximum value of the carburizing concentration is present at a depth of about 10 to 50 $\mu$m, and the carburizing concentration is decreased as the depth is further increased. From these descriptions, in the continuous carburizing method of metal strip in the present invention, in the case where the total carburizing quantity is constant, on the basis of the carbon diffusion model formula, the carburizing concentration is set at one point in the depth range of 10 to 50 $\mu$m in order to acquire a peak point of the carburizing concentration distribution form thereby to definitely settle the carbon diffusion model formula, and even when the total carburizing quantity is different, the carburizing concentration is set at another point or more points in the depth range of 10 to 250 $\mu$m thereby to definitely settle the carbon diffusion model formula. As a result, it is possible to set a metal strip temperature, atmospheric gas composition, and a carburizing time which are the parameters of the carbon diffusion model formula, by calculating a carburizing concentration distribution form in which a carburizing concentration at each point in the depth direction which satisfies the above-mentioned settled carbon diffusion model formula is in a predetermined tolerance range of a target value.

Furthermore, assuming that, even when the total carburizing quantity is not set, it is also possible to set a carburizing quantity by integrating in the depth direction a carburizing concentration distribution obtained by the carbon diffusion model formula. Furthermore in the continuous carburizing method of metal strip in the present invention, it is of course possible to apply the surface reaction rate of the above-mentioned surface reaction-governing area.

Furthermore, in the continuous carburizing method of metal strip in the present invention, in the carburizing process, the solid solution C existing in the metal strip surface layer portion is still in a state capable of diffusion or decarburization, and it is possible to fix the solid solution C to a desired carburizing concentration distribution condition by controlling the diffusion or decarburization of the solid solution C by controlling a metal strip temperature after the carburizing, for example, a cooling rate of the steel plate.

BRIEF DESCRIPTION OF THE DRAWINGS

In the attached drawings, FIG. 14 is an explaining diagram of a generation gas composition result and an actually measured result calculated in accordance with an atmospheric composition model formula used in an embodiment of the present invention.

BEST MODE FOR IMPLEMENTING THE INVENTION

Figure 2:
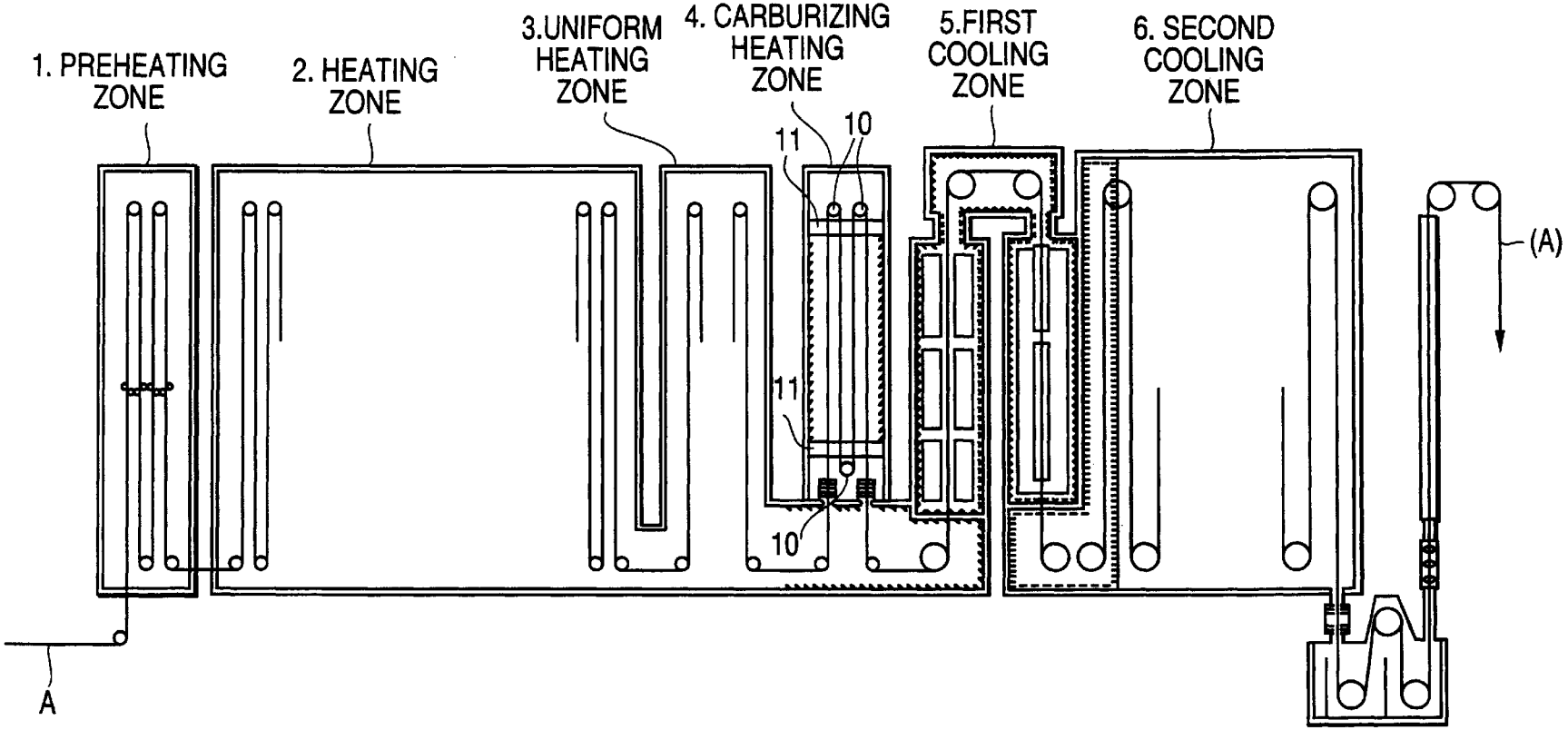
FIG. 2 is a schematic arrangement diagram showing an example of the continuous annealing and carburizing facility which is the object of carburizing control using a method of continuously carburizing a metal strip of the present invention.

FIG. 2 shows an example of a continuous annealing and carburizing facility of a strip consisting of an extremely low carbon steel embodying the continuous carburizing method of metal strip of the present invention.

Figure 1:
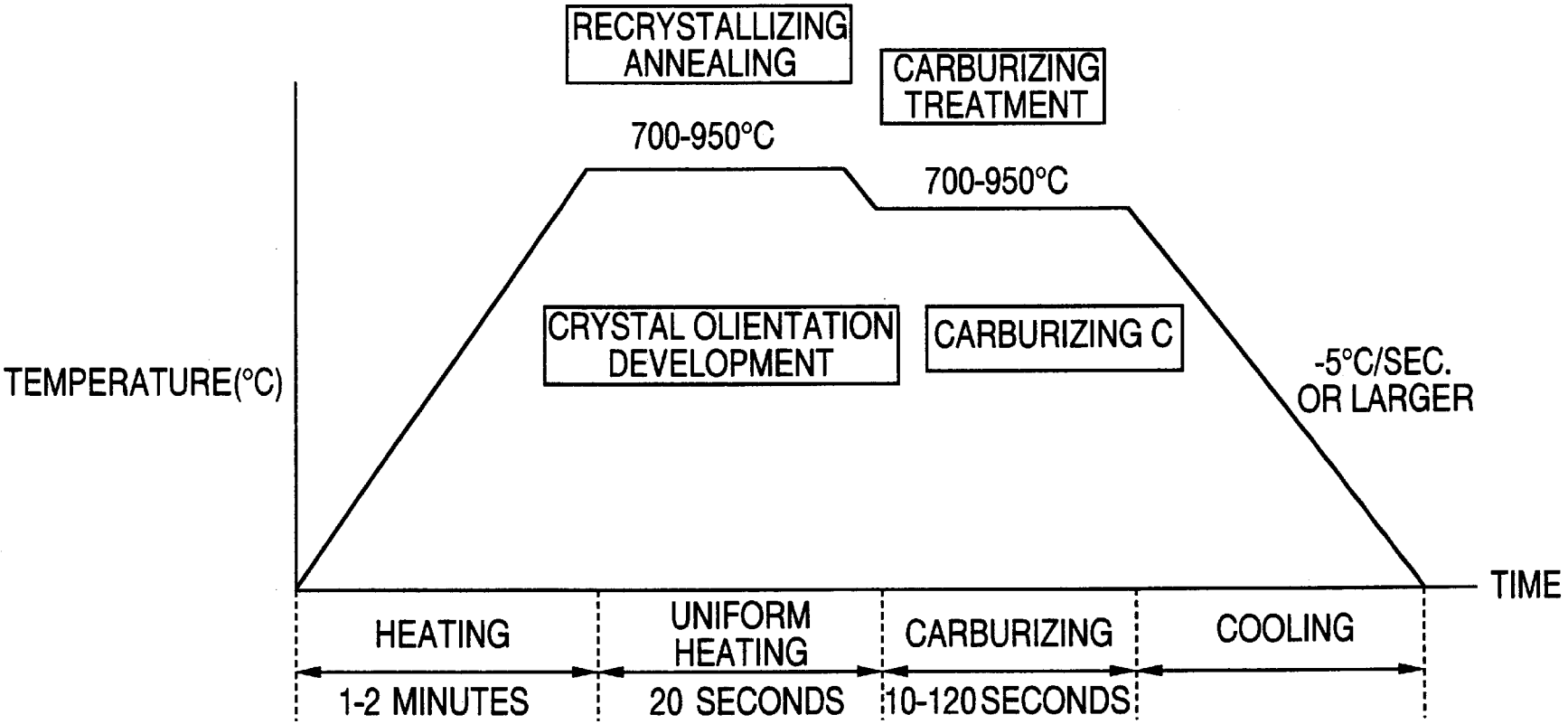
FIG. 1 is an idea explaining diagram of a heat treatment process performed in a continuous annealing and carburizing facility.

In the figure, an extremely low carbon steel strip A is plate-passed in the order of an enter side facility not shown in the figure and including a coil unwinding machine, a welding machine, a cleaning machine, etc., a preheating zone 1, a heating zone 2, a uniformly heating zone 3, a carburizing zone 4, a first cooling zone 5, a second cooling zone 6, and an exit side facility not shown and including a shearing machine, a winding machine, etc. so as to satisfy complications and history of plate temperature control as shown in FIG. 1 described in the foregoing.

In the heating zone 2, the strip A which is continuously plate-passed from the enter side facility and preheated in the preheating zone 1 is heated to a recrystallizing temperature or higher, and specifically, to a furnace temperature of 850 to 1000° C., and the strip is heated so that a temperature of the strip A reaches 700 to 950° C. The heated strip A is held in the uniformly heating zone 3 at the recrystallizing temperature or higher for a required time, and it is possible to develop a congregated structure {1, 1, 1} which is advantageous to a deep drawing property.

In the vicinity of a plate-passing path of the strip A which is plate-passed through hearth rolls moving up and down in the heating zone 2 and the uniformly heating zone 3, there are disposed with many radiant tubes, and a fuel gas supplied into the radiant tubes is burnt to control an inside-furnace temperature (furnace temperature). In setting a supply flow rate of the fuel gas, an upper limit value of the furnace temperature is set by a host computer not shown and described later from heat balance taking into consideration heat transfer coefficients among the radiant tubes, strip, hearth rolls, etc. And this setting is performed together with a plate-passing speed which achieves an in-furnace time (heating time, uniformly heating time) in each heat treatment zone on the basis of a process model calculation which satisfies upper and lower limit values of a desired recrystallization temperature, an optimum route calculation which calculates an optimum time series of the plate-passing speed at a joint portion between the coils, a thermal crown calculation which calculates a maximum plate-passing speed by predicting and calculating a heat crown of the hearth rolls, or the like. Here, in this embodiment, the setting of the supply flow rate of the fuel gas into the radiant tubes is equivalent to a required (necessary) heat quantity by the furnace determined from incomings and outgoings of heat in the furnace which is obtained by adding exhaust gas lost heat and furnace body radiating heat to a heating quantity applied to the strip which brings out heat quantity from the furnace when it is plate-passed. This setting is made possible by the host computer not shown in accordance with control algorithm of the overall line which will be described later.

In the carburizing zone 4, in order to form a carburized phase in a surface of the strip A in which solid solution carbon (C) is present in a very thin portion (surface layer portion) of the surface of the strip A, a carburizing furnace in the carburizing zone 4 is controlled by the host computer not shown to a metal strip temperature of 700 to 950° C., and a plate-passing speed is controlled so that the strip is passed through the carburizing furnace taking 10 to 120 seconds with the temperature of 700° C. or higher, preferably at a recrystallizing temperature or below. This control is performed so that a carburizing quantity (carburizing reaction rate x carburizing time) is constant with respect to a plate-passing direction of the strip, and that deviation in material characteristics is suppressed. In this respect, the furnace temperature control is performed to avoid the problem that when the strip temperature is below 700° C., the carburizing reaction rate is lowered and the heat treatment productivity is reduced whereas when the furnace temperature exceeds 950° C. the material characteristics are deteriorated, and this control is performed to meet the carburizing conditions. Furthermore, as is known, when sooting occurs, that is, when tree carbon (C) affixes on a surface of the steel plate, it causes the deterioration of fermentation treatment property, the degradation of quality, and harmful influences in post-processes. On the other hand, when the reaction in the furnace is promoted in a predetermined direction, for example, in a carburizing reaction direction, and when a dew point is raised as a result, the carburizing reaction will be disturbed, and the strip surface will be oxidized to cause temper color. For this reason, the physical properties within the furnace and the furnace temperature are strictly controlled in accordance with carburizing conditions setting algorithm as will be described later.

The composition and the supply and exhaust flow rate of carburizing gas supplied into the carburizing furnace are controlled in accordance with various conditions which are calculated by the host computer on the basis of a thermodynamics (atmospheric composition) model formula which makes free energy in the furnace minimum by considering the incomings and outgoings of materials in the furnace which will be described later. The composition and the supply and exhaust flow rate of carburizing gas are controlled to prevent the sooting, and at the same time, to prevent the reduction of the carburizing reaction rate and the temper color by suppressing the rise of the dew point. Needless to say, the top priority is placed on the specification factors of the strip including a carburizing concentration distribution, a carburizing depth, etc., of a carburized layer which is formed on the strip which will be described later, and the composition and the supply and exhaust flow rate of carburizing gas are calculated in view of the above-mentioned plate-passing speed and the furnace temperature.

The physical properties within the furnace, furnace temperature, metal strip temperature, plate-passing speed i.e. carburizing time, and atmospheric gas composition are regarded as physical quantities (control variables) which are the objects to be controlled in actual continuous carburizing, and by the host computer, for example, a required carburizing quantity is set from the specification factors including the carburizing concentration distribution, carburizing depth, etc., of a required carburized layer to be formed on the strip, and each control variable to achieve the carburizing quantity is calculated by suitably selecting various basic formulas relating to these preset control variables described later, and these control variables are set by considering the capability and processes of the other facilities.

The strip is plate-passed in the carburizing furnace while moving up and down through hearth rolls 10, and in order to maintain the rolling property and roll crown of the hearth roll 10 in a predetermined state, for example, the vicinity of a bearing or the like is cooled. Furthermore, in order to maintain the strength and wear resistant property of the roll itself, chrome Cr alloy is used for the hearth roll. When the carburizing atmospheric gas reaches the vicinity of the hearth roll, it is cooled and the sooting progresses, and thus, C diffuses into the inside of the hearth roll after C affixes to the hearth roll. When this occurs, the above-mentioned Cr and C are bonded and carbide is precipitated. As a result, crystal grains of heat resistant alloy used in the hearth roll are broken or expanded, and since the solid solution Cr is reduced on the other hand, the hearth roll becomes fragile and is oxidized, and porous corrosion progresses. In this manner, if the hearth roll is exposed to the carburizing atmospheric gas, according to the experiments of the inventors of the present application, it was found that the hearth roll must be replaced within two years. Accordingly, in the present embodiment, a hearth roll chamber is separated from the carburizing atmosphere by a non-contact sealing device a so that the deterioration of the hearth roll is prevented. Furthermore, the inside of the hearth roll chamber is made in a slightly carburizing state to the extent that the deterioration of the hearth roll does not progress, and it was successful to prevent the so-called decarburization in which C is dissipated from the carburized surface layer portion while the strip passes through the separated hearth roll chamber. In the case where the time for the strip to pass through the hearth roll chamber is very short, and the decarburization from the surface layer portion of the steel plate does not raise a problem in relation to the passing time, the inside of the hearth roll chamber may be non-carburizing atmosphere.

The structure of the sealing device 11 is not described in detail here, however, for example, a sealing layer inter posed between the hearth roll chamber and the carburizing atmosphere chamber is made a three layers structure, a nd the above-mentioned slightly carburizing atmospheric gas is jetted into a sealing layer at the hearth roll chamber side, the above-mentioned carburizing atmospheric gas is jetted into a sealing layer at the carburizing atmosphere chamber side, and the exhaust is performed from an intermediate sealing layer. Furthermore, the jetting direction and the jet flow rate of each atmospheric gas are controlled so that the flow of each atmospheric gas is directed to the intermediate sealing layer side, and at the same time, the circulating flow generated by a plate surface gas flow caused by the plate-passing of the strip is discharged from an exhaust port formed in an end face of the sealing layer, the end face being positioned in a width direction of the strip.

The strip A sent out from the carburizing zone 4 is plate-passed to the first cooling zone 5. In the first cooling zone 5, in order to fix the solid solution C carburized in the carburizing zone 4 to a very thin range of a surface of the surface layer portion of the strip, the strip after the carburizing is rapidly cooled to a steel plate temperature of 600° C. or lower, preferably at a cooling rate of 5° C./sec. until about 500 to 400° C. is reached. In the cooling zone 5, in order to achieve this cooling conditions, a flow rate, flow velocity, cooling roll angle, wrap angle, and the like of a cooling gas blown from a cooling gas jet against the strip transported into the cooling zone are controlled by the host computer.

The strip A sent out from the cooling zone 5 is plate-passed to the second cooling zone 6. In the second cooling zone 6, the gas cooling is performed until the steel plate temperature reaches 250 to 200° C. In this manner, ultimately, it is possible to obtain a cold-rolled steel plate for extremely low carbon press forming in which the amount and form of the solid solution C in the surface layer portion is controlled.

Next, as to the continuous annealing and carburizing facility of the embodiment, the idea of overall continuous annealing and carburizing control performed by the host computer will be explained. In this respect, for the sake of easy understanding, hereinafter, the temperature of the metal strip relating to the carburizing reaction is described as a carburizing temperature, however, it is apparent from the contents of the previous description that the substantial control factor is a furnace temperature.

As described in the foregoing, in the carburizing control in the carburizing zone, including the case where the carburizing concentration distribution in the steel plate is required, the carburizing quantity into the steel plate is given as preconditions to obtain target material characteristics. For example, when the carburizing concentration distribution is required, the carburizing quantity is set by integrating the distribution in a depth direction. The upper limit of carburizing temperature is set to a recrystallizing temperature or lower from the material characteristics conditions. On the other hand, in order to obtain maximum capability of the carburizing furnace, it is necessary to increase the carburizing reaction rate based on the principle of carburizing quantity=carburizing reaction rate×carburizing time, and from this necessity, it is desirable to make the carburizing temperature which is associated with the carburizing reaction rate higher, and this is also related to raise the CO concentration upper limit.

In this embodiment, the generation limit of the sooting can be obtained by the thermodynamics (atmospheric composition) model formula which takes into consideration the incomings and outgoings of materials, however, it is difficult to set a CO concentration and an $H_2$ concentration related to atmospheric composition only from the condition that the sooting does not merely occur. For this reason, in the present invention, a relation formula which does not disturb the carburizing reaction rate is set beforehand, and for example, using as a reference the CO concentration obtained by the atmospheric composition model formula which does not generate the sooting, the $H_2$ concentration is calculated by using the relation formula. Specifically, it is expressed as follows.

$$H_2 \text{ Concentration} = a \times (\text{CO concentration})$$

here, a constant in the range of $0 \leqq a < 5$

The constant a is set by a basic formula of a surface reaction rate described later, to a value which suppresses a production concentration of CO and $H_2O$ to a minimum, and usually it is set in a range of 0.5 to 1.0, that is, when this relation formula is satisfied, the carburizing reaction rate based on the surface reaction rate formula becomes maximum.

Furthermore, in this embodiment, the carburizing time to achieve a desired carburizing concentration distribution is set on the basis of the above-mentioned set surface reaction rate. In other words, when the gradient to the C concentration in the inner layer portion is to be made steep by increasing only the C concentration in the surface layer portion, it is only necessary to increase the carburizing reaction rate (enhancing the carburizing capability) and to reduce the carburizing time. Conversely, when the C concentration gradient of the inner layer portion to that of the surface layer portion is to be made gradual by increasing the whole C concentration of the steel plate, it is only necessary to increase the carburizing time by reducing the carburizing rate (lowering the carburizing capability). The control of these carburizing reaction rate and the carburizing time satisfies the above-mentioned restricting condition that the carburizing quantity is constant.

On the other hand, as described in the items of the heating zone and the uniformly heating zone, also in respective plate temperature control zones other than the carburizing zone, an optimum plate-passing speed is set by capability calculations and process calculations of respective furnaces. When considering a maximum plate-passing speed of each plate temperature control zone and a maximum plate-passing speed of the carburizing zone, in the continuous annealing and carburizing facility in which the strip is plate-passed serially, it must be judged which of the plate-passing speeds governs the plate-passing speed of the whole facility. In this case, all the specification factors of the steel plate must be considered, and still the specification factors are given as absolute conditions.

From the above description, when the maximum plate-passing speed obtained in the carburizing zone is lager than a minimum value of each maximum plate-passing speed obtained in each plate temperature control zone, it is necessary to set the minimum value of the maximum plate-passing speed of each plate temperature control zone as a line plate-passing speed, and to set again atmospheric conditions of the carburizing furnace which satisfies the above-mentioned carburizing quantity at this plate-passing speed. In this case, since the carburizing time increases, under the restricting condition that the carburizing quantity is constant, the setting will be made again in a direction in which the carburizing reaction rate is decreased, that is, the CO concentration and the $H_2$ concentration in the atmospheric gas are reduced, and hence the condition that the sooting is not generated will be necessarily satisfied.

Conversely, when the minimum value of the maximum plate-passing speed obtained in each plate temperature control zone is equal to or larger than the maximum plate-passing speed obtained in the carburizing zone, it is necessary to set the maximum plate-passing speed of the carburizing zone to the line plate-passing speed, and to set again the furnace temperature and the fuel supply quantity as the plate temperature control variables in order to satisfy the plate temperature of each plate temperature control zone by this plate-passing speed.

Figure 4:
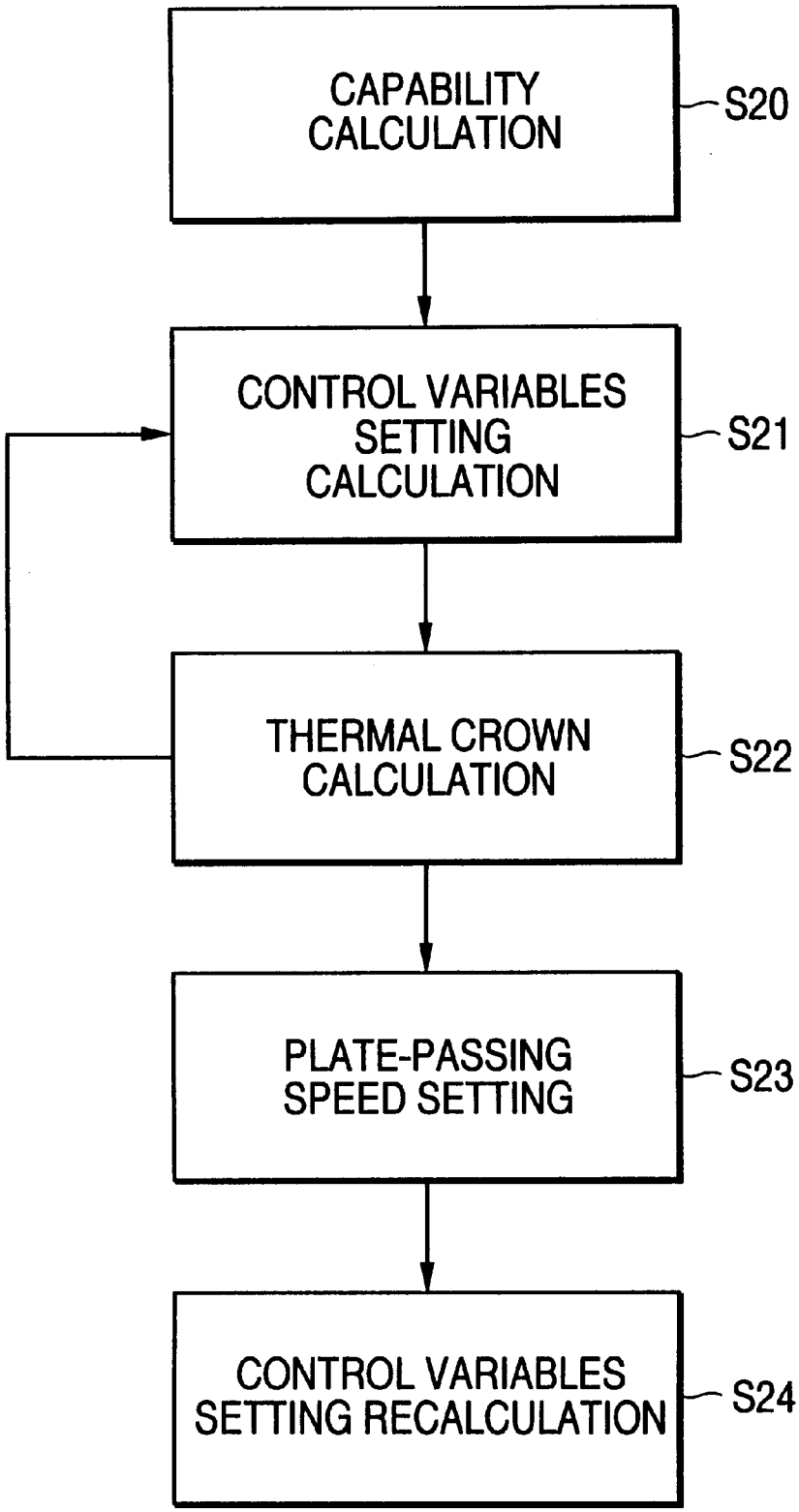
FIG. 4 is a flowchart of algorithm which constitutes logic of overall line control performed in the continuous annealing and carburizing facility of FIG. 2.

These control ideas are embodied as algorithm shown in FIG. 4 which is performed by the host computer.

In th is calculation processing, first, in step S20, in the carburizing zone and each plate temperature control zone, making an upper limit of the facility capability as the restricting condition, a maximum value of the plate-passing speed which satisfies heating, carburizing, and cooling specifications for each kind of steel plate is set. Specifically, for example, in the heating zone 2 and uniformly heating zone 3, on the basis of a mathematical formula model based on a heat transfer theory, a process model formula is set from heat balance which takes into consideration the heat transfer among the radiant tubes, furnace wall, strip, hearth rolls, etc. On the basis of this process model formula, a maximum value (hereinafter described as a maximum plate-passing speed) of the plate-passing speed is calculated within the range of a furnace temperature, a fuel gas supply quantity or a capacity of an electrical heating apparatus possible to be set in view of the facility, and also so that the calculated maximum value can satisfy the target plate temperature.

On the other hand, in the carburizing zone 4, on the basis of a mathematical formula model based on thermodynamics described later, an atmospheric gas composition model in the carburizing furnace which takes into consideration the incomings and outgoings of materials in the carburizing furnace is set. From this atmospheric gas composition model and the carburizing reaction rate formula, a maximum plate-passing speed which is equal to or smaller than the upper limit value of the atmospheric gas composition (specifically, CO) and which satisfies the target carburizing quantity is calculated.

Furthermore, in the cooling zones 5 and 6, on the basis of a model formula which takes into consideration the cooling gas by cooling gas jet and the heat transfer of the strip, a maximum plate-passing speed which is within the range of cooling gas supply capability and which satisfies the target cooling rate/the target cooling completion temperature is calculated.

In this respect, in the cooling zones 5 and 6, when a cooling roll system or a mist cooling system other than the gas jet system is used as the cooling system, similar calculation may be performed by using a model formula which takes into consideration the medium used in these cooling systems and the heat transfer of the strip.

Then, the maximum plate-passing speed in each heat treatment zone including the carburizing zone calculated as described above is compared with each other, and a minimum value is set as the maximum plate-passing speed in the whole line.

Next, in step S21, by using the maximum plate-passing speed in the whole line which is set in the step S20, in each heat treatment zone including the carburizing zone, a set value of control variables which satisfies the steel plate heating, carburizing, and cooling specifications is obtained.

Specifically, for example, in the heating zone 2 and uniformly heating zone 3, by using the heat transfer model described in the step S20, a furnace temperature which satisfies the target plate temperature is set. This plate temperature may be controlled by controlling the fuel gas supply flow rate or the load of the electrical heating apparatus by feedback control. Alternatively, the control of plate temperature may be performed in that on the basis of the process model calculation described previously, an optimum time series of the fuel gas supply flow rate or the load of the electrical heating apparatus which makes minimum the plate temperature variations in the joint portion of the coils of the steel plate is calculated by optimum route calculation, and based on this result, feedforward control may be performed.

On the other hand, in the carburizing zone 4, there are some cases, in one case, the target value includes only the carburizing quantity, and in another case, together with the carburizing quantity, the target value of a C concentration distribution form in a thickness direction of the steel plate is designated. In the case where only the target carburizing quantity is designated, by using the atmospheric gas composition model described in the step S20 and the carburizing reaction rate formula of the steel surface, an atmospheric gas composition which satisfies the target carburizing quantity is calculated. In contrast, in the case where together with the carburizing quantity, the target value of a C concentration distribution form in a thickness direction of the steel plate is designated, by using together with the atmospheric gas composition model and the carburizing reaction rate formula of the steel surface, the in-steel diffusion model considering not only the carburizing time but also the cooling period, a plate-passing speed is set again so that this plate-passing speed is within the range of the maximum plate-passing speed or smaller of the whole line set in the step S20, and this plate-passing speed enables to set the target C concentration distribution form in a thickness direction of the steel plate. At the same time, an atmospheric gas composition which satisfies the target carburizing quantity is calculated. In this case, the plate-passing speed which is set again is set as a plate-passing speed of the whole line in steps following the present step. In this embodiment, the logic of the plate-passing speed setting to make the C concentration distribution form in a thickness direction of the steel plate satisfy the target value in the step S21, however, in order to prevent the set plate-passing speed from being changed and set again due to other causes, the setting of the plate-passing speed which satisfies the C concentration distribution form in a thickness direction of the steel plate is preferable to perform in step S23. Thus, in the embodiment, it is performed in step S23.

In the cooling zones 5 and 6, by using the heat transfer model described in the step S20, the flow velocity of the cooling gas jet is set by the number of revolutions of a fan, or the like so as to satisfy the target cooling rate and the target cooling completion time.

Next, in step S22, heat crown of the hearth rolls in each heat treatment zone including the carburizing zone is predicted and calculated by a plate temperature model and a heat balance model of a roll chamber, and a maximum plate-passing speed which falls within the jetting generation limit and the buckling generation limit of the strip is calculated, that is, a so-called thermal crown calculation is performed. When the maximum plate-passing speed calculated here is larger than the maximum plate-passing speed of the whole line which is set in the steps up to the step S21, goes to the next step S23. On the other hand, when the maximum plate-passing speed calculated here is smaller than the maximum plate-passing speed of the whole line which is set in the steps up to the step S21, the maximum plate-passing speed obtained in this thermal crown calculation is set again as a plate-passing speed of the whole line, and moves to the above-mentioned step SS21.

In the step 23, when a plate-passing speed which is the target is designated beforehand by the reasons of operation such as welding work of a joint portion of the coils, coil inspection, and the like, or some other reasons (mainly troubles), after checking that the designated plate-passing speed is equal to or smaller than the maximum plate-passing speed of the whole line which is set in the steps S20 to S22, the plate-passing speed of the whole line is set to the designated plate-passing speed.

Next, in step S24, with respect to the ultimately set plate-passing speed of the whole line, control variables which satisfy the steel plate heating, carburizing, and cooling specifications in each heat treatment zone including the carburizing zone are calculated, and are set. In this step, the contents of the calculation are similar to that in the step S21, however, the setting and calculation of the plate-passing speed based on the C concentration distribution form in the depth direction of the steel plate are not performed.

In the explanation of the logic, in the carburizing zone 4, the description of the plate temperature control to satisfy the target plate temperature is omitted, however, the plate temperature control in the carburizing zone 4 may be considered to be the same contents as the plate temperature control in the heating zone 2 and uniformly heating zone 3.

Next, the carburizing atmosphere control performed in the carburizing zone will be explained.

First, it will be explained on the basis of the specification factors of the strip required to obtain a steel plate having a press forming property as in the previously described low AI-high BH steel plate and also having the strength, as to in what level the carburizing treatment conditions in the present embodiment are placed as compared with the conventional carburizing treatment conditions, and as to the items required to meet the carburizing treatment conditions.

Figure 3:
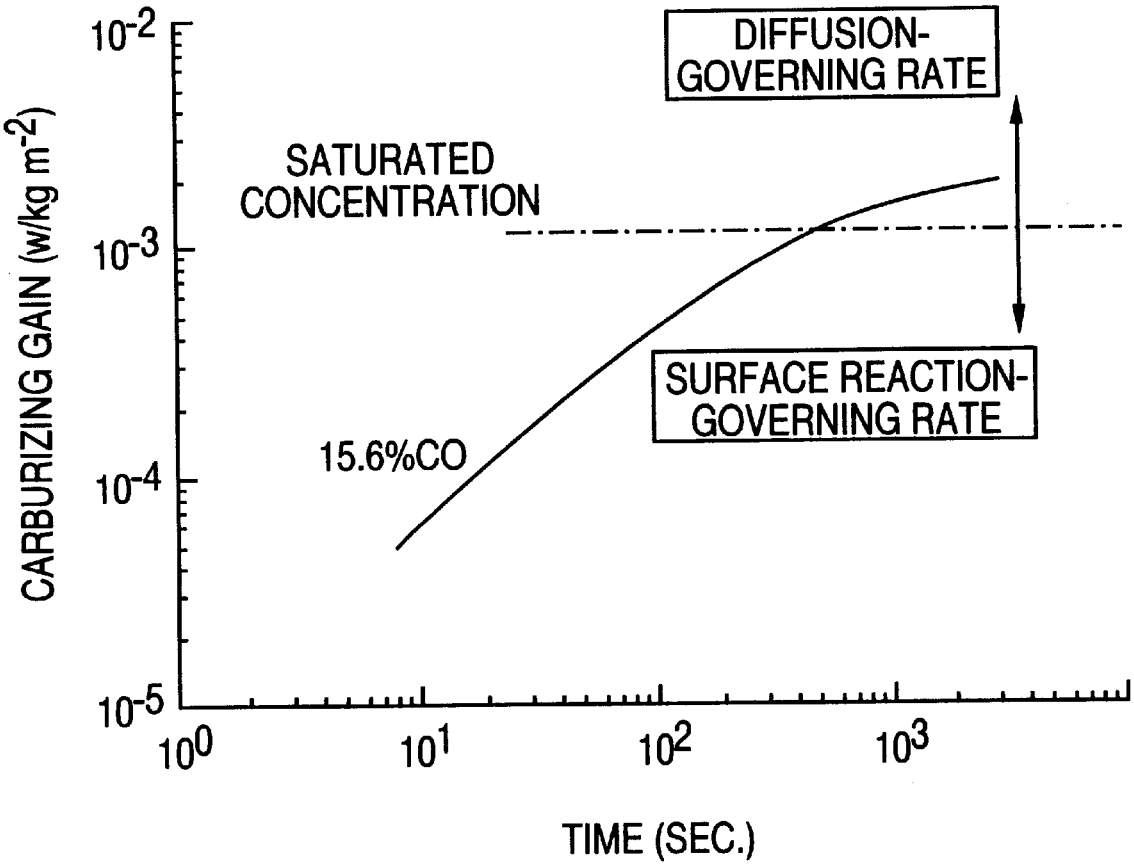
FIG. 3 is an explaining diagram of a diffusion-governing area after a carbon concentration in the metal strip surface layer portion reaches an equilibrium concentration and a surface reaction-governing area before the equilibrium concentration is reached.

The conventional carburizing technique is carried out for the purpose of surface hardening to improve the wear resistant property and anti-impulse property of a discontinuous article consisting of a so-called thermally refined steel such as a gear, shaft, bearing, etc. Accordingly, the C content in a raw material is 0.05% or larger, and the required carburizing quantity is 0.1% or more, and the carburizing depth is 0.5 to 1.5 mm or larger. Thus, the needed time for carburizing is as long as 1 to 5 hours. Under such conditions, the C concentration in the steel plate surface layer portion has reached the equilibrium concentration with respect to time, and hence the carburizing rate is in an in-steel diffusion-governing area as shown in FIG. 3 wherein the carburizing rate follows a diffusion rate into the steel, and the carburizing rate is proportional to square root of time. In this carburizing rate area, it is necessary to control the carbon potential (C potential) of the atmospheric gas so that the in-steel diffusion rate becomes equal to the surface reaction rate thereby to make the in-steel equilibrium C concentration assumes a predetermined value. As an actual operation control index, the control of $CO/CO_2$ is important.

In contrast, in the continuous carburizing of the strip in the present embodiment, the strip is a discontinuous article consisting of the extremely low carbon steel, and it is performed for the purpose of improving the surface characteristics of the strip and improving the material characteristics of the steel plate itself. Accordingly, when the carburizing conditions of the metal strip are obtained from the specifications (Japanese Patent Laid-Open Publication Hei No. 3-199344, etc.) required for metal which is intended to improve the anti-secondary working brittleness, in the present embodiment, the C content in the raw material is 200 ppm or less, the carburizing depth is 50 to 200 $\mu$m, and the carburizing time dependent on the plate-passing speed is 120 seconds or less. Under such conditions, since the C concentration in the steel plate surface layer portion does not reach the equilibrium concentration with respect to time, as described in the report by Yo et al. mentioned previously, the carburizing rate is in a surface reaction-governing area as shown in FIG. 3 wherein the carburizing rate follows the reaction rate in the steel surface, and the carburizing rate is proportional to time itself. In this surface reaction-governing area, since both the carburizing quantity and the carburizing depth are in a non-equilibrium state, as actual operation control indices, it is necessary not only to control $CO/CO_2$ by the control of the C potential so as to attain the equilibrium C concentration in the surface layer portion in the steel, but also it is necessary to set carburizing conditions so as to obtain the carburizing quantity determined from the specification factors of the required steel plate taking into consideration many control variables in the furnace.

Furthermore, in the actual continuous annealing and carburizing operation, there are many cases, for example, as in the algorithm shown in FIG. 4, the plate-passing speed is set from the plate temperature control which is performed in heat sections other than the carburizing zone, and also in many cases the plate-passing speed having the most fast response from various operation conditions is controlled. Hence, in the continuous carburizing method in the present invention, in the case where the plate-passing speed is restricted by the continuous annealing and carburizing operation conditions other than the carburizing treatment, carburizing conditions are set from the specification factors of the steel plate required under the above-mentioned plate-passing speed so that the set carburizing conditions satisfy the carburizing quantity.

Here, the basic principles for constructing logic in accordance with the algorithm which is processed by the host computer in order to control the carburizing quantity in the present embodiment will be explained.

First, in controlling the composition of the atmospheric gas in the surface reaction-governing area, it is necessary to prevent the generation of sooting as described in the foregoing, and at the same time, to suppress the rise of the dew point. The generation mechanism of these states is reasoned as follows.

Generally, the atmospheric gas composition in carburizing condition can be obtained from chemical equilibrium. In conventional solution, conceivable reactions are all listed, and the gas composition is obtained by solving non-linear simultaneous equations from the equilibrium relationships of the reactions. However, it is very difficult to obtain the accurate limit of soot generation (sooting) only from the reaction formula of gaseous phase system.

Hence, in the present embodiment, a thermodynamics (atmospheric composition) model formula is conceived as described below, and the atmospheric gas composition which prevents the sooting generation is obtained.

In the case of an isothermal and isotactic system, Gibbs's free energy is reduced in a change which occurs naturally, and the Gibbs's free energy in the system assumes a minimum value in the equilibrium state accordingly, in order to obtain the equilibrium state of the atmospheric gas, using as the objective function the Gibbs's free energy of the whole system obtained by making each component gas concentration of the production system as a variable, it is only necessary to obtain each component gas concentration which assumes a minimum value under the restricting condition of the incomings and outgoings of materials in which element components which are brought into by the original system are constant, specifically, under the restricting condition that the atmospheric gas composition and the supplied quantity supplied into the furnace and the C quantity which is brought out by the metal strip from the furnace due to carburizing are constant. This component gas concentration becomes an equilibrium composition of the atmospheric gas in the furnace at a given furnace temperature and a given furnace pressure, and the sooting C quantity is expressed as one kind of condensation in the logic described below.

In calculating the composition of the atmospheric gas, two assumptions are set. One of the two assumptions is that, the gas is an ideal gas. The other is that the condensation phase represented by free C cannot be mixed with the gas. Under this assumptions, the total free energy F(X) of a kind of gas and a kind of condensation is represented by the following equation 1 with respect to free energy $f^g_i$ of i th kind of gas and free energy $f^g_h$ of h th kind of condensation.

$$F(X) = \sum_{i=1}^{n} f_i^z = \sum_{h=1}^{p} f_h^c \tag{1}$$

here, n: the number of kinds of gases, p: the number of kinds of condensations.

In this respect, the free energy $f^g_i$ of i th kind of gas relating to the gas product is expressed by the following equations 2 to 4 supposing that the number of moles of the kind of gas is $x^g_i$ with respect to free energy $C^g_i$ of i th kind of gas.

$$f_i^g = x_i^g(C_i^g + 1n(x_i^g / X)) \tag{2}$$

$$C_i^g = (F/(R \cdot T))_i^g + 1nP \tag{3}$$

$$X = \sum_{i=1}^{n} x_i \tag{4}$$

On the other hand, as to the condensation product, since the influence of pressure and mixing is removed under the assumptions described before, free energy $f^c_h$ of h th kind of condensation is expressed by the following equations 5 and 6 supposing that the number of moles of that kind of condensation is $x^c_h$ with respect to mole energy $C^c_h$ of h th kind of condensation.

$$f_h^c = x_h^c \cdot C_h^c \tag{5}$$

$$C_h^c = (F/(R \cdot T))_h^c \tag{6}$$

In the equations 3 and 6, (F/(R·T) ) is defined by the following equation 7.

$$(F/(R \cdot T))_i = ((F - H_{298})/T)_i / R + \Delta H^0_{f,298,i} / RT. \tag{7}$$

Next, the incomings and outgoings of materials in this system are considered. Even when each component quantity in the production system is changed, each element, that is, when viewed as to an atom unit of carbon C, hydrogen H, nitrogen N, oxygen O in the atmospheric gas components, respective total quantity is constant. This incomings and outgoings of materials are expressed by the following equation 8.

$$\sum_{i=1}^{n} a_{ij}^g \cdot x_i^g + \sum_{h=1}^{p} a_{hj}^c \cdot x_h^c = b_j \tag{8}$$

where, j=1, 2, . . . , m $a^g_{ij}$: the number of atoms of j th element contained in a molecule of i th kind of gas, $a^c_{ij}$: the number of atoms of j th element contained in a molecule of i th kind of condensation, $b_j$: the quantity of j th element existing in the system, and m: the number of kinds of elements existing in the system.

Here, in the embodiment, a linearized atmospheric composition model formula is set from the equations 8 and 1 by a program stored in the host computer, and the solutions obtained from the atmospheric composition model formula are converged to obtain an optimum solution.

In accordance with the atmospheric composition model formula, a generated gas composition in the carburizing furnace is calculated the result of calculation and the result of actual measurement are shown in FIG. 14.

As will be apparent from FIG. 14, as to the gas composition in the furnace, the calculated results are well in coincident with the actual measurement values.

Next, in considering the necessary conditions of the atmospheric gas composition in the actual continuous carburizing, the C balance in the furnace is given by the following equations 9 and 10. In this respect, the equation 10 is a function which is calculated from the specification factors and the surface reaction rate.

$$W_i^g = W_c^s + W_o^g \quad (9)$$

$$W_c^s = \xi(V, t, w, LS) \quad (10)$$

where, $W^g_i$: C mass in the atmospheric gas entered into the furnace, $W^g_c$: C mass brought out by the strip, $W^g_o$: C mass in the atmospheric gas exits from the furnace, V: surface reaction rate, t: carburizing time, and w: plate width.

In this manner, by calculating the atmospheric factors on the basis of the thermodynamics (atmosphere composition) model formula which takes into consideration the incomings and outgoings of materials in the actual continuous carburizing in the carburizing furnace, it becomes possible to enhance the carburizing capability of the atmosphere composition as compared with the atmospheric factors which are obtained without considering the incomings and outgoings of materials in the furnace, while preventing the generation of sooting with certainty. Accordingly, it is possible to improve the actual operation capability in which, for example, the plate-passing speed is increased by increasing the CO concentration in the atmospheric gas.

Next, the principles of the carburizing quantity control which constitutes the main portion of the embodiment will be explained.

The surface reaction when CO is used as the atmospheric gas is considered as the following equations 11 to 13.

$$CO \Leftrightarrow [C] + O \quad (11)$$

$$CO + O \rightarrow CO_2 \quad (12)$$

$$Fe + [C] \rightarrow Fe - C \text{ (in-steel diffusion)} \quad (13)$$

According to the report by Yo et al., described previously, when the C concentration in the steel plate surface layer portion is very low and the carburizing time is very short, the carburizing condition does not reach the equilibrium state. For this reason, since the reaction rate in equation 13 is faster than the elimination reaction of adsorped oxygen in equation 12, it is assumed that this reaction is a rate-governing reaction, and a surface reaction rate V in this surface reaction-governing area is expressed by the following equation 14.

$$V = k \cdot PCO(PCO/(PCO+(ac/K))) \quad (14)$$

where, k: reaction rate constant, P co: CO gas partial pressure, ac: carbon activity, K: equilibrium constant.

However, in the equation 14, the influence of $H_2$ is not considered. As to the reaction equation relating to $H_2$, the reaction represented by the following equation 15 is supposed with respect to the reaction equation of the equation 12.

$$CO + H_2 + 2O \rightarrow CO_2 + H_2O \quad (15)$$

Furthermore, as to the produced $CO_2$, the reaction represented by the following equation 16 is supposed.

$$H_2 + CO_2 \Leftrightarrow H_2O + CO \quad (16)$$

On the basis of these reaction equations, and in view of the fact that $H_2$ has the effect to promote the carburizing reaction, in the embodiment, the basic surface reaction rate V is expressed by the following equation 17.

$$V = k_1 f_1(PCO, PH_2, \theta_0) \quad (17)$$

where, $\theta_0$: coating rate of adsorped oxygen.

Furthermore, when the concentration of CO and $H_2$ in the atmospheric gas which is generated by carburizing is high (e.g., $CO/CO_2 \leqq 50$), the carburizing reaction is disturbed by the reaction represented by the following equations 18 and 19.

$$C + CO_2 \Leftrightarrow 2\ CO \quad (18)$$

$$C;\ H_2O \Leftrightarrow CO + H_2 \quad (19)$$

Accordingly, in the embodiment, by considering these disturbing factors of the carburizing reaction, the surface reaction rate V is represented by the following equation 20 or 21.

$$V = k_1 \cdot f_1(PCO, PH_2, \theta_0) \times \alpha \cdot f_3(PCO, PCO_2) \quad (20)$$

$$V = k_1 \cdot f_1(PCO, PH_2, \theta_0) - k_2 \cdot f_2(PCO_2, PH_2O) \quad (21)$$

where, $\alpha$ : constant, k1, k2: reaction rate constants.

The reaction rate constants $k_1$ and $k_2$ can be set by the following equation 22.

$$k_i = A_i \cdot \exp(-E_i/RT) \quad (22)$$

where,

Ai: frequency factor, Ei: activation energy, R: gas constant, and T: absolute temperature.

Figure 5:
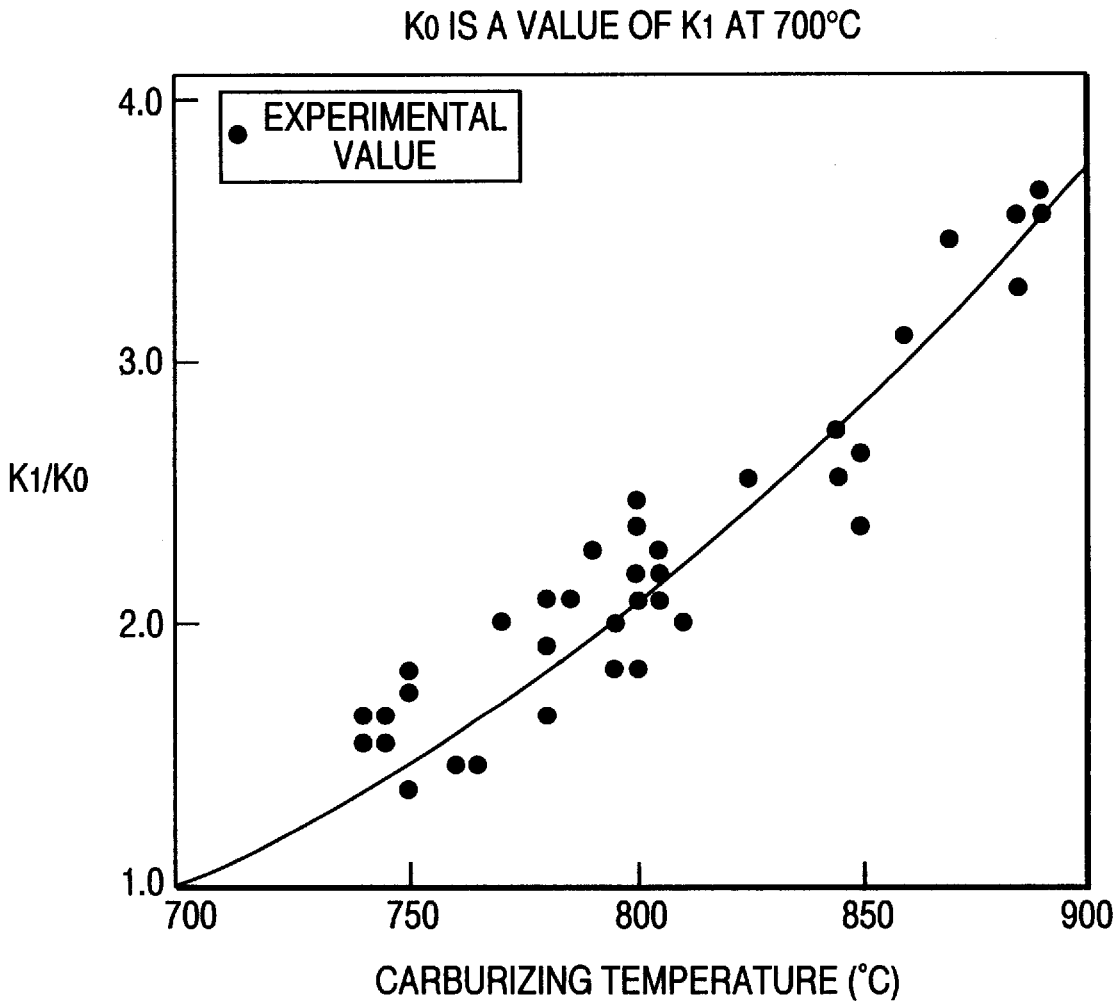
FIG. 5 is a temperature coefficient correlation diagram of data obtained by changing a carburizing temperature in order to calculate a temperature dependency coefficient of a surface reaction rate in a continuous annealing method of metal strip in the present invention.

Since, the frequency factor Ai, activation energy Ei, and gas constant R are constants, the reaction rate constants $k_1$ and $k_2$ are calculated from experimental values under the conditions of various absolute temperatures T. FIG. 5 shows reaction rate constant $k_1$ obtained by experiments.

In the embodiment, when it is only necessary to consider the CO concentration, for example, when the supply gas flow rate is large, the equation 14 may be used as a surface reaction rate formula.

Next, the in-steel diffusion of solid solution will be explained in which the in-steel diffusion is made in the form of a model in the embodiment in order to obtain a desired carburizing concentration distribution. The diffusion state of C into the steel is represented by a carbon diffusion model formula shown in the following equation 23 on the basis of a Fick's law.

$$dC/d\ t = D \cdot d^2C/dX\ ? \quad (23)$$

where,

C: C concentration in steel, t: time, D: diffusion coefficient, and X: diffusion distance.

The diffusion coefficient D is set also by Arrhenius's formula represented by the following equation 24, in the embodiment, it is represented approximately by actual measurement data.

$$D=\exp(a\cdot T^{-1}+b) \quad (24)$$

where,

T: carburizing temperature, a: proportional coefficient, and b: constant.

Accordingly, the carburizing quantity into the steel plate can be calculated by the equation 17 or 21 or 22 and 23. This means that under the condition that the carburizing quantity is constant, if a carburizing concentration at one point of a desired carburizing concentration distribution is set, then the above-mentioned carbon diffusion model formula will be set, and even when the carburizing quantity is differrent, if carburizing concentrations at two points or more of the desired carburizing concentration distribution are set, then the above-mentioned carbon diffusion model formula will be set. Furthermore, as described previously, when the plate-passing speed is restricted by operation condition other than the carburizing treatment, since the carburizing time t is determined to a value obtained by dividing the effective carburizing furnace length L by the plate-passing speed Ls, this calculated value is used in time integrating the equation 23 by the carburizing time.

Figure 6:
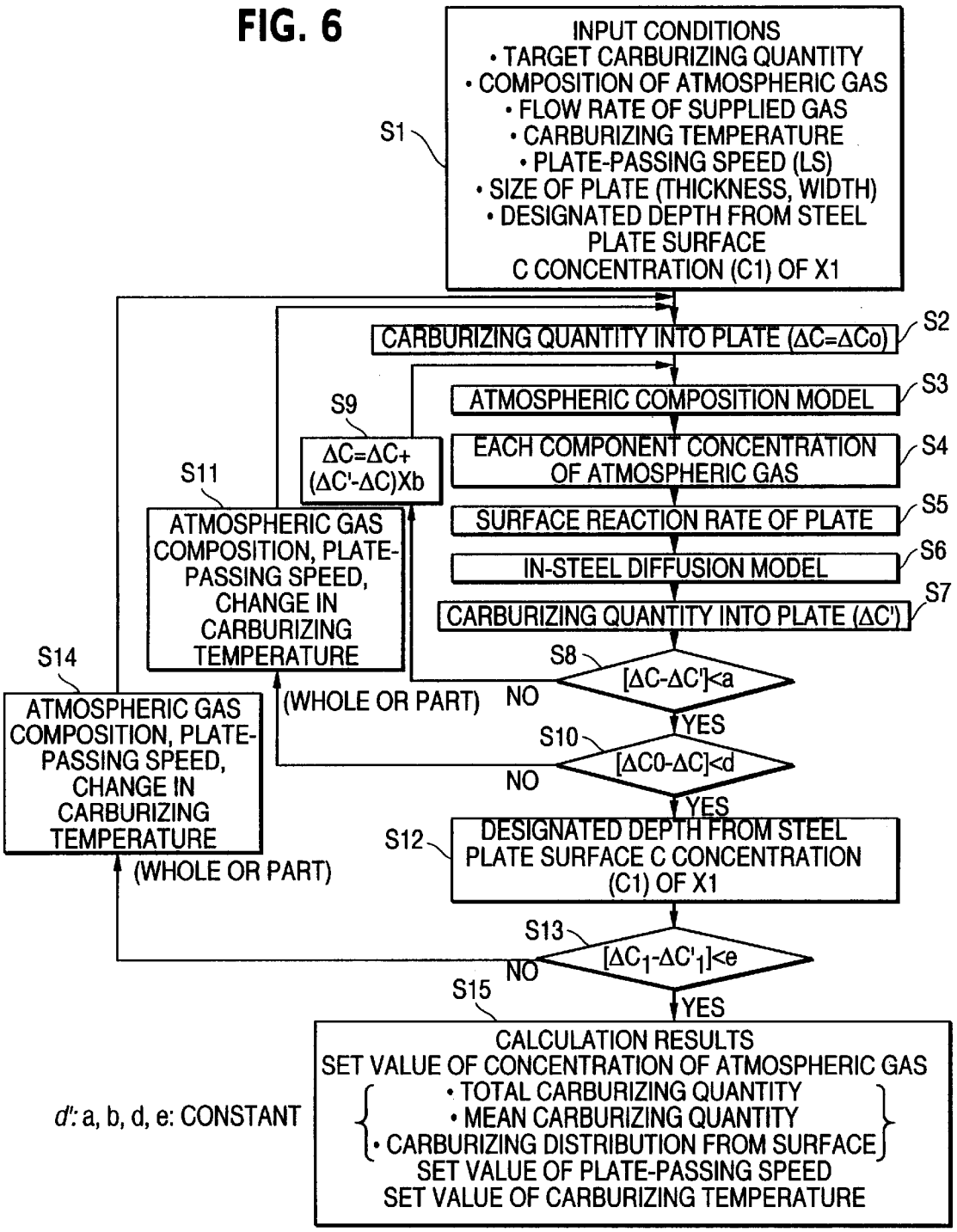
FIG. 6 is a flowchart of algorithm which constitutes an embodiment of logic for performing carburizing control by using the continuous carburizing method of metal strip in the present invention.
Figure 7A:
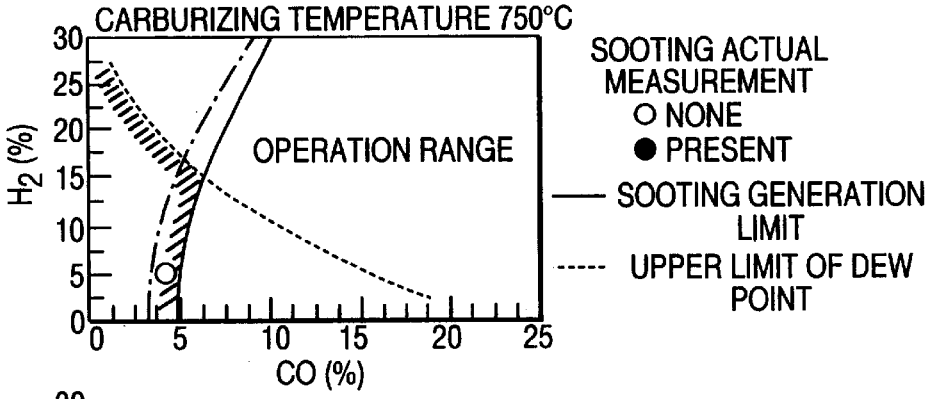
FIG. 7 is a CO-$H_2$ characteristic diagram as compared with a sooting generating limit obtained in the continuous carburizing method of metal strip in the present invention.
Figure 7B:
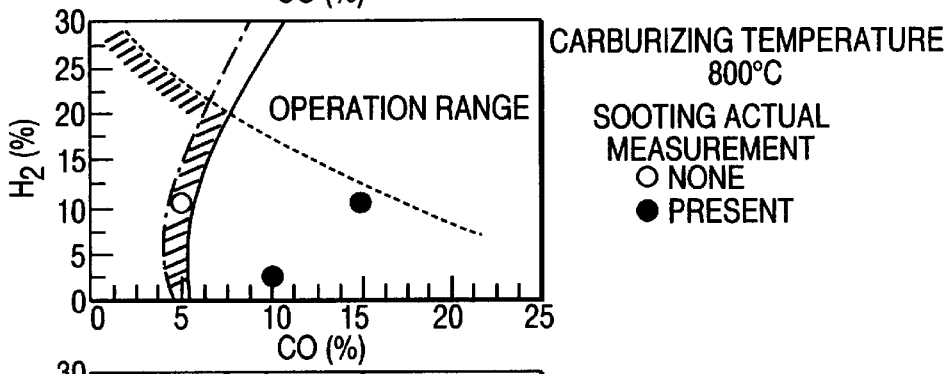
Figure 7C:
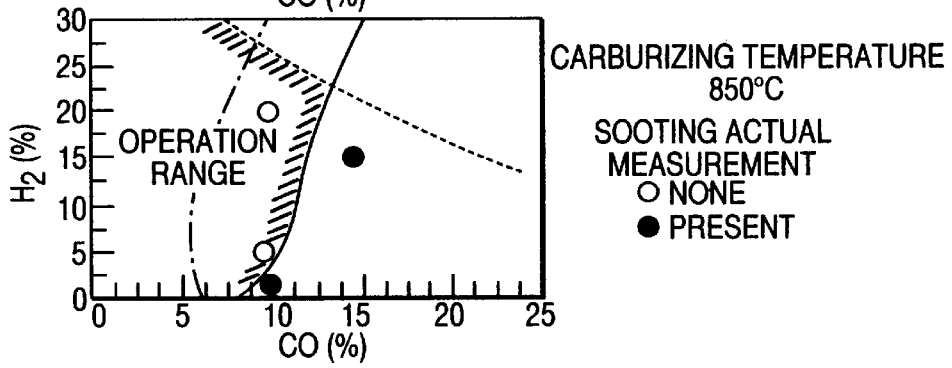
Figure 7D:
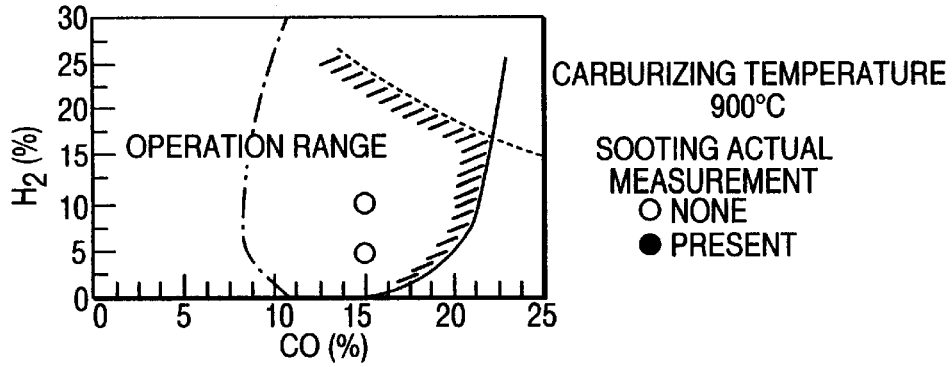

FIG. 6 shows a flowchart of algorithm for setting a carburizing condition in which the above-described calculations are sequentially performed by a program stored beforehand in the host computer, and under this carburizing condition, the specification factor of the steel plate after carburizing, that is, the carburizing quantity into the strip which is given from a desired carburizing concentration distribution in the embodiment coincides with the carburizing quantity into the strip calculated from a decreased quantity of C in the atmospheric gas.

First, in step S1, from the set conditions which is given as steel plate specification factors after carburizing, such conditions as an atmospheric gas composition, flow rate of supplied gas, carburizing temperature and plate-passing speed are read, and from the steel plate factor and carburizing concentration distribution, such condition as a C concentration $C_1$ at a designated depth $X_1$ from the steel plate surface is read. Also, here, for example, the plate-passing speed is represented by LS, and this is a parameter which is modified in subsequently performed flow.

Next, in step S2, a carburizing quantity ΔC into the steel plate is set from the steel plate factors and the steel plate specification, and a C quantity per unit time which is brought out by the strip from the carburizing furnace is calculated.

Next, in step S3, the atmospheric composition model formula mentioned above is set from the composition of atmospheric gas which was read in the step S1.

Next, in step S4, in accordance with the atmospheric composition model formula set in the step S3, each component concentration of the atmospheric gas taking into consideration the C quantity brought out by the strip from the carburizing furnace is calculated.

Next, in step S5, on the basis of the equation 17, a surface reaction rate of the steel plate is calculated.

Next, in step S6, on the basis of the equation 23, a carburizing rate into the steel is calculated, and a C diffusion quantity into the steel is calculated.

Next, when the carburizing treatment time is elapsed, goes to step S7, and the surface reaction rate or the diffused C quantity per unit time and unit area calculated in the step S5 or step S6 is integrated by the treatment time and the steel plate total surface area, and a carburizing quantity ΔC' into the steel plate is calculated.

Next, in step S8, the absolute value of a difference between the set carburizing quantity ΔC and the carburizing quantity ΔC' obtained as a result of the calculation is judged whether it is smaller than a predetermined value a or not, and when the absolute value of the difference is smaller than the predetermined value a, goes to step S10, and if not, goes to step S9.

In the step S9, on the basis on the above-mentioned carburizing quantity, the set carburizing quantity is corrected based on the following equation 25, and goes to the step S3.

$$\Delta C=\Delta C+(\Delta C'-\Delta C)\times b \quad (25)$$

where, b: constant.

Accordingly, when the total C quantity brought out by the step from the carburizing furnace and the total C quantity carburized are equal to each other, that is, when the incomings and outgoings of materials within the carburizing furnace are satisfied, goes to step S10.

In the step S10, the absolute value of a difference between the target carburizing quantity $\Delta C_O$ and the set carburizing quantity ΔC is judged whether it is smaller than a predetermined value d or not, and when the absolute value of the difference is smaller than the predetermined value d, goes to step S12, and if not, goes to step S11.

In the step S11, in order to obtain the set carburizing quantity set from the carburizing concentration distribution condition, any one or more of the parameters of the atmospheric gas flow rate, atmospheric composition, plate-passing speed, and carburizing temperature, and goes to the step S2. Here, when the plate-passing speed LS is corrected in order to correct the difference between the predetermined carburizing quantity $\Delta C_O$ and the set carburizing quantity ΔC, it is only necessary to calculate, for example, based on the following equation 26 the plate-passing speed LS which is to be corrected.

$$LS=LS+(\Delta C-\Delta C_0)\times d' \quad (26)$$

where, d': constant.

In the step S12, in accordance with the in-steel diffusion model set in the step S6, a C concentration $C'_1$ at the designated depth $X_1$ from the steel plate surface is calculated.

Next, in step S13, it is judged whether the absolute value of a difference between the set C concentration $C_1$ at the designated depth $X_1$ from the steel plate surface read in the step S1 and the C concentration $C'_1$ at the designated depth $X_1$ from the steel plate surface calculated in the step S12 is smaller than a predetermined value e or not, and when the absolute value of the difference is smaller than the predetermined value, goes to step S15, and if not, goes to step S14.

In the step S14, in order to obtain the set carburizing quantity which is set from the carburizing concentration distribution condition, any one or more parameters of the atmospheric composition, plate-passing speed, and carburizing temperature are changed, and goes to the step S2.

In the step S15, each set value of the concentration of atmospheric gas component or the plate-passing speed, or the carburizing temperature obtained as a result of the above calculation is outputted in accordance with the object of the control, and at the same time, the calculation results such as the total carburizing quantity, mean carburizing quantity, carburizing distribution, etc., are outputted, and the program is completed.

In the flowchart of FIG. 6, the atmospheric gas flow rate in the input conditions is a control variable for changing the $CO_2$ and $H_2O$ concentrations in the atmospheric gas as described previously, and as the control factors, the atmospheric composition is intended to be included therein similar to the $CO+H_2$ flow rate which is supplied into the furnace.

FIG. 7 shows by the solid line, a generation limit of sooting at each carburizing temperature calculated by the program taking into consideration the incomings and outgoings of materials under the plate-passing conditions in the industrial continuous carburizing operation in which conditions the plate-passing speed LS=200 mpm, plate thickness D=0.75 mm, plate width W=140 mm, and supply gas quantity=1000 N $m^3$/hr. In the figure, the broken line shows a dew point upper limit. Furthermore, the long and short dash line shows sooting generation limit obtained without taking into consideration the incomings and outgoings of materials. And in the figure, the hatched portion shows an operation range in the actual carburizing operation.

As will be apparent from the figure, in the sooting generation limit obtained by considering the incomings and outgoings of materials, as compared with the sooting generation limit obtained without considering the incomings and outgoings of materials, both the CO concentration and $H_2$ concentration become high. That is, the carburizing rate is improved by this increase in the concentration. On the other hand, the higher the carburizing temperature, the higher becomes the CO concentration and $H_2$ concentration following the sooting generation limit. Since this means that the overall carburizing operation efficiency depends also on the temperature, conversely, when the plate-passing speed is made fast, the degree of freedom in the operation is increased allowing to increase the furnace temperature to the extent acceptable to the material characteristics. Thus, the setting range of various conditions in the actual continuous carburizing is enlarged. Of course, even when the operation range is set along the sooting generation limit obtained without considering the incomings and outgoings of materials in the furnace, the sooting is not generated. However, the degree of freedom in the operation is decreased to that extent, and the setting range of various conditions is narrowed.

Figure 8:
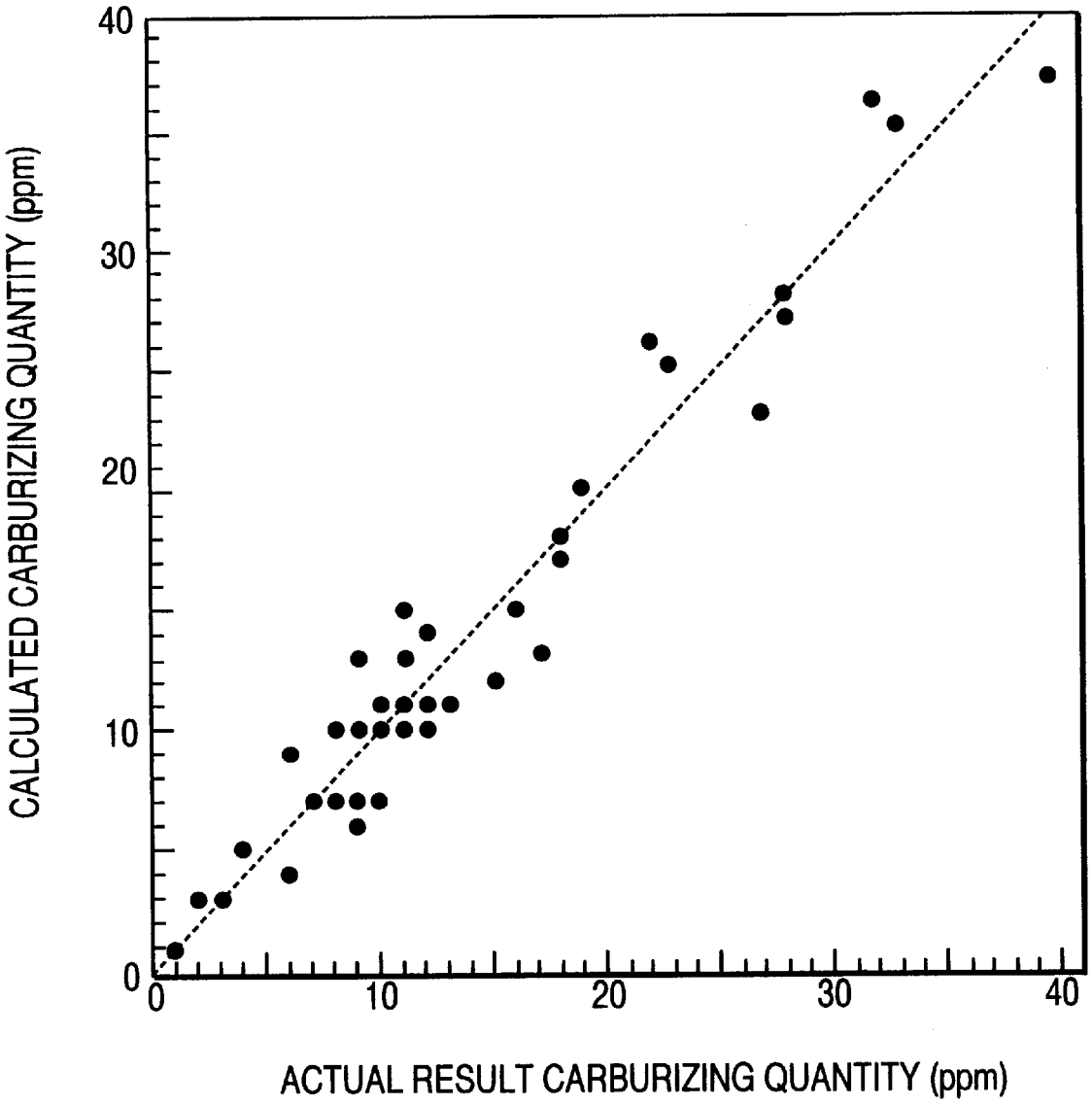
FIG. 8 is a correlation diagram between a calculated value and an actually measured value of a carburizing quantity obtained in the algorithm of the embodiment in FIG. 6.

Furthermore, FIG. 8 shows the correlation between the carburizing quantity in the case where each carburizing condition calculated by the program, that is, each control variable is changed, and the actually measured carburizing quantity. As will be apparent from the figure, the calculated carburizing quantity and the actually measured value coincident with each other to a great extent. This means that the setting of the carburizing rate, that is, the surface reaction rate, and the setting of its temperature dependency coefficient are correct, and also means that, as far as the setting of the surface reaction rate is correct, the continuous carburizing method of the present embodiment can be applied to a wide range of area in which the carburizing rate follows the surface reaction rate which is larger than the diffusion rate.

Furthermore, concrete calculation examples of the control variables for the purpose of carburizing quantity control calculated by the program will be explained based on FIG. 9.

Figure 9:
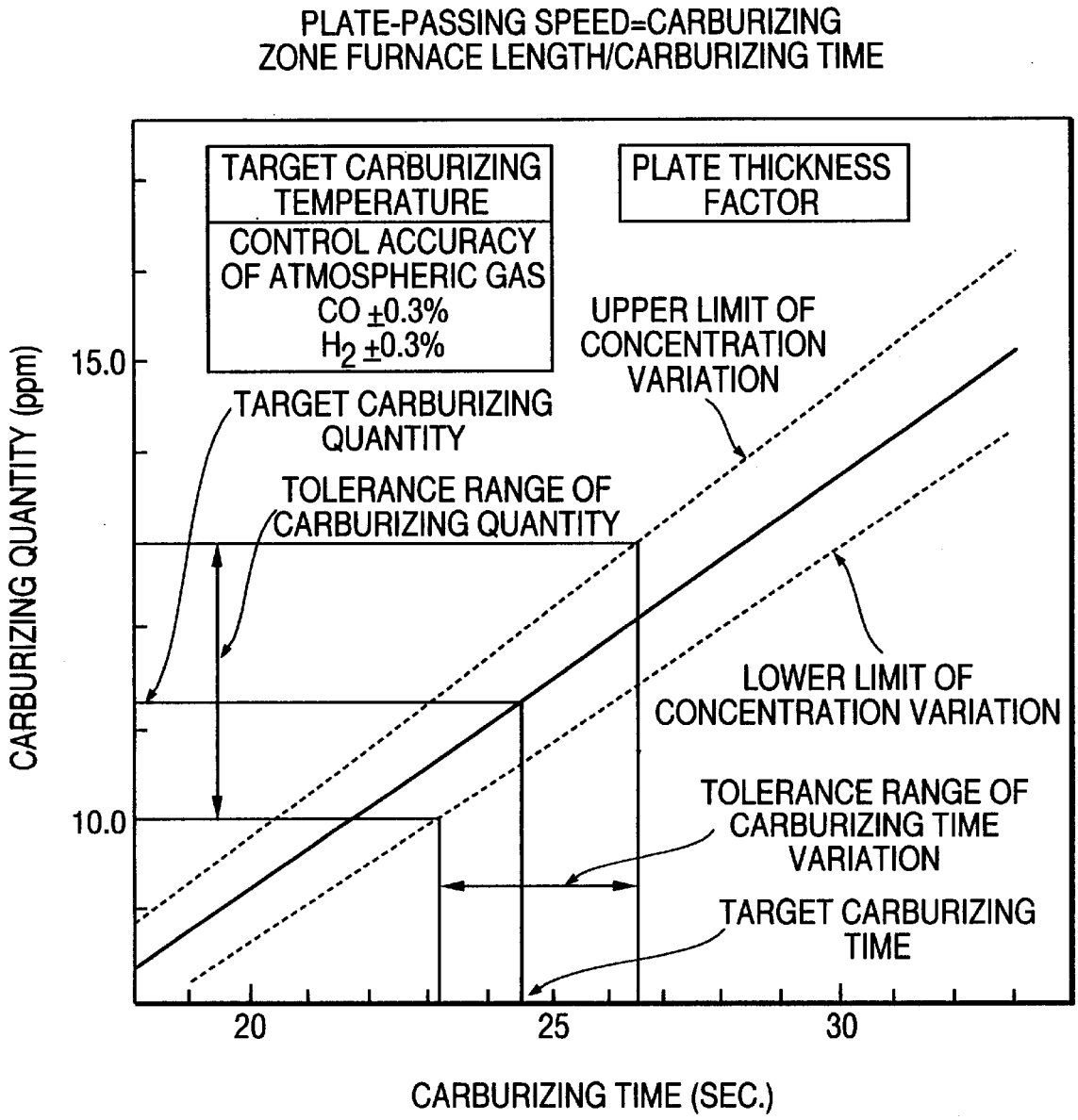
FIG. 9 is an explaining diagram of various carburizing conditions calculated to obtained a target carburizing quantity by the algorithm of the embodiment in FIG. 6.

Here, for example, from the steel plate factors such as the plate thickness factor, or the like read in the step S1, the predetermined (target) carburizing quantity was set in the step S2 as apparently shown in FIG. 9, and at the same time, the tolerance range to the plate thickness was set. Also, in the step S1, the target carburizing temperature was set from the material condition of the steel plate.

Accordingly, in the step S3 and the step S4, the CO concentration and H2 concentration are set as the atmospheric gas condition to prevent sooting.

Supposing that the control accuracy of the atmospheric gas component concentration is +0.3% in the actual apparatus, according to the equations 17 to 23 which are calculated in the flow in the step S3 to step 11, as is apparentely shown in FIG. 9, the target carburizing time is set, and at the same time, the tolerance range of the carburizing time variation is set.

Next, with respect to the carburizing zone furnace length, since the plate-passing speed is represented by plate-passing speed=carburizing zone furnace length/carburizing time, in the step 12, the target plate-passing speed and its tolerance range are set and outputted.

In this manner, at the time point when the carburizing quantity and the atmospheric gas composition are set, in the loop of the step S10 and step S11, the carburizing time (plate-passing speed) is set.

As described above, in the embodiment, in the area in which the carburizing rate is governed by the surface reaction rate, it is possible to set the various carburizing conditions for obtaining the carburizing quantity set from the plate factors, to optimum conditions in view of the overall operation conditions, and it became possible to completely automate these control operations which have been conventionally relied on experiences.

Furthermore, in the case where the plate-passing speed is restricted by the operation condition other than the carburizing treatment, the concrete calculation examples of control variables for the purpose of the carburizing quantity control calculated by the program will be explained with reference to FIG. 10.

Here, for example, from the steel plate factors such as the plate thickness factor, or the like read in the step S1, in the step S2, the predetermined (target) carburizing quantity is set. Also, in the step S1, the target carburizing temperature was set from the material characteristic condition of the steel plate. Furthermore, the carburizing time is calculated by dividing the effective carburizing furnace length by the plate-passing speed.

Next, in the step S3 and the step S4, the upper limits of the CO concentration and $H_2$ concentration are set as the atmospheric gas condition for preventing sooting.

In contrast, in the flow in the steps S3 to S9, the surface reaction rate formula and the in-steel diffusion model formula are set, and from these formulas, the CO concentration, $H_2$ concentration, $CO_2$ concentration, and $H_2$ O concentration which are required to achieve the target carburizing quantity are set.

Figure 10:
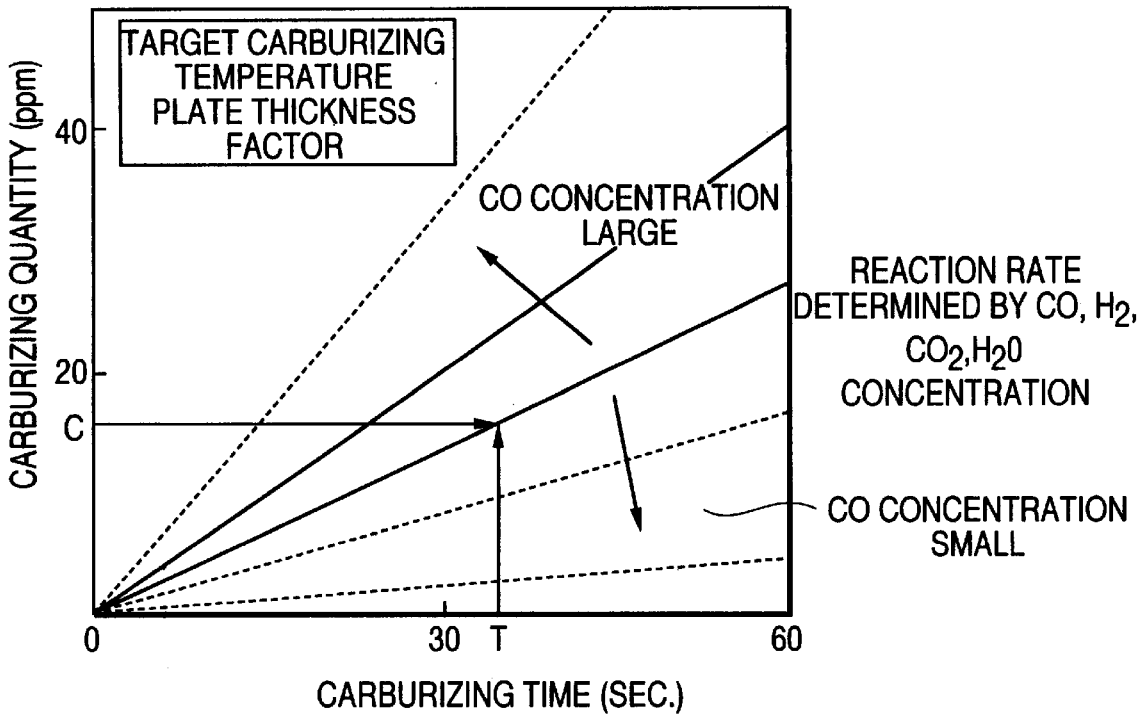
FIG. 10 is an explaining diagram of various carburizing conditions calculated to obtained a target carburizing quantity under conditions wherein a plate-passing speed is set by the algorithm of the embodiment in FIG. 6.

Accordingly, as shown in FIG. 10, when the target carburizing quantity is increased or the carburizing time is decreased, the atmospheric gas composition is controlled, for example, so that the CO concentration in the atmospheric gas is increased, whereas when the target carburizing quantity is decreased or the carburizing time is increased, the atmospheric gas composition is controlled, for example, so that the CO concentration in the atmospheric gas is decreased.

In this respect, as a method of controlling the atmospheric gas composition exhausted from the carburizing furnace at the carburizing furnace temperature, for example, as to the $CO+H_2$ concentration, the ratio of the CO flow rate and the $H_2$ flow rate in the atmospheric gas flow rate supplied to the carburizing furnace may be changed, and as to the $CO_2$ and $H_2O$ concentrations, the total flow rate of the atmospheric gas may be changed.

As described above, in the embodiment, even when the plate-passing speed is restricted beforehand, it is possible to set the various carburizing conditions for obtaining the carburizing quantity which are set from the plate factors, to optimum conditions while considering the overall operation conditions, and it became possible to completely automate these control operations which have been conventionally relied on experiences.

Next, with reference to FIGS. 11 to 13, calculation examples will be explained in which the carburizing concentration distribution desired for the carburized thin steel plate is calculated by the carbon diffusion model formula based on the Fick's law. According to the algorithm of FIG. 6, the carburizing quantity per unit area is set by integrating the carburizing concentration distribution in the depth direction, and the carbon diffusion model formula is set from a desired carburizing concentration distribution under a restriction condition which satisfies the carburizing quantity. Then, a tolerance range is set for a target value at each point in the depth direction, and the carburizing temperature and the carburizing time which are parameters of the model formula are set so that a carburizing concentration profile calculated from the carbon diffusion model formula falls within the tolerance range.

Figure 11:
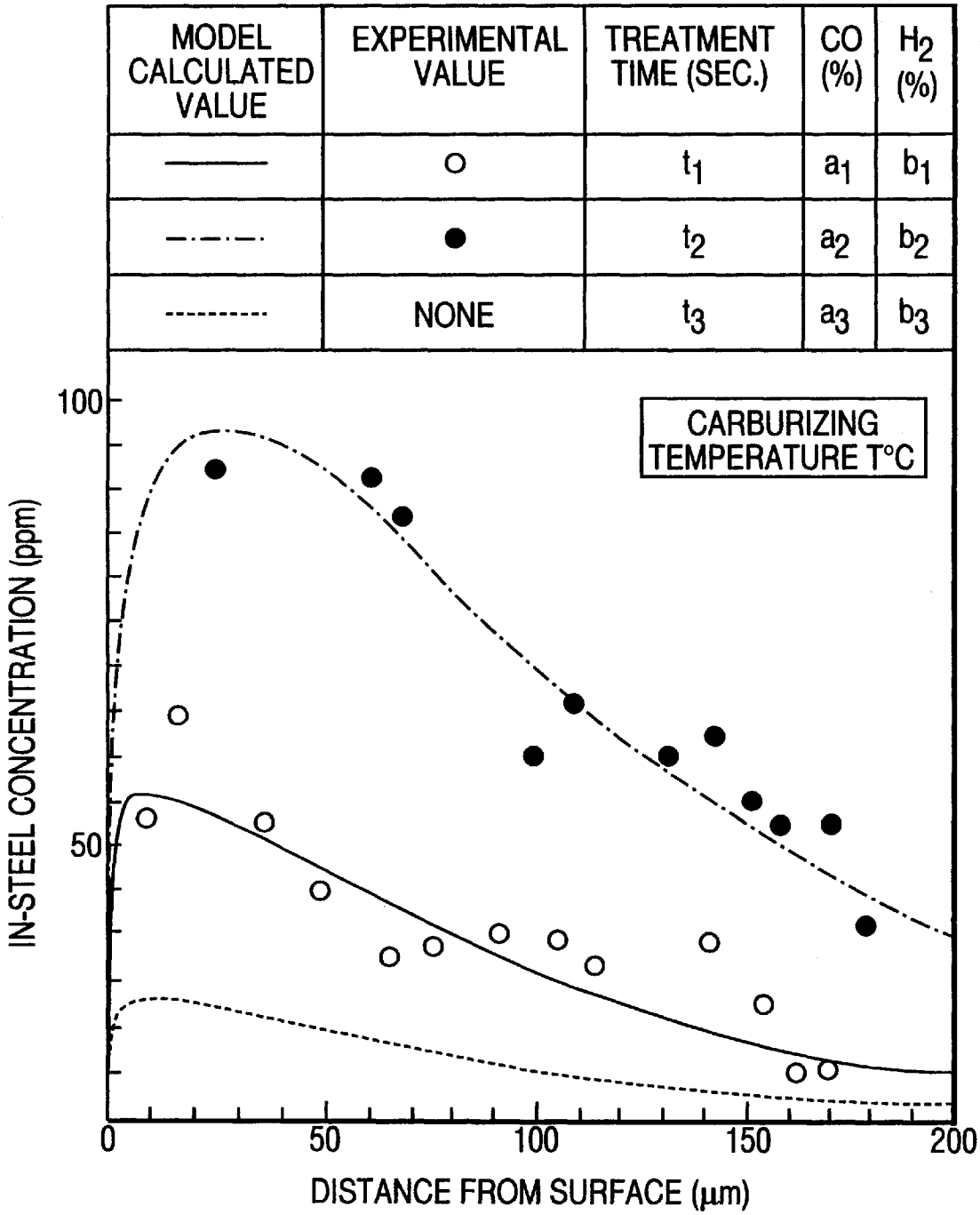
FIG. 11 is an explaining diagram of an example of correlation between a carburizing concentration distribution and an actually measured carburizing concentration distribution obtained in accordance with a carbon diffusion model formula by using the continuously carburizing method of metal strip in the present invention.

However, in the carburizing concentration distribution form shown in FIG. 11, there is a peak of the carburizing concentration at a depth of about 10 to 50 $\mu$m from the metal strip surface, and the carburizing concentration is gradually decreased i n a range from the peak to a deeper depth of 250 $\mu$m. This is because that originally, at a portion directly near the surface of the surface layer portion at which the carburizing concentration is the highest, the decarburization progresses in the process of cooling of the sealing portion. Thus, in order to make the form of the carburizing concentration distribution coincide with the carbon diffusion model formula, it is only needed to set the carburizing concentration at two points or more in the form of the carburizing concentration distribution in the range of the depth of 10 to 250 $\mu$m from the surface. Preferably, in order to acquire the peak point of the carburizing concentration, it is desired to set the carburizing concentration at one point in the range of the depth of 10 to 50 $\mu$m, and at one point or more in the range of 100 to 250 $\mu$m. However, in the case where the carburizing quantity is constant, if the carburizing concentration is set at only one point under the condition in which various conditions such as surface reaction rate and carburizing temperature, carburizing time, and the like, are set, the carbon diffusion model formula will be set directly or uniquely.

Here, under the carburizing conditions in which the carburizing time (treatment time, sec.) is $t_1$, $t_2$, $t_3$, and the CO concentration (%) is $a_1$, $a_2$, $a_3$, the $H_2$ concentration is $b_1$, $b_2$, $b_3$, and the carburizing temperature is T (° C.) constant, the correlation curve between a distance from the metal strip surface, i.e., a depth ($\mu$m) and an in-steel carbon concentration (carburizing concentration, ppm), and the actually measured value data are shown in FIG. 11. In this case, however, above-mentioned carburizing time $t_1=t_2\neq t_3$, and the CO concentration $a_1=a_3\neq a_2$, and the $H_2$ concentration $b_1=b_2=b_3$. In FIG. 11, in actually measuring the carburizing concentration, a test piece is put into fluorine acid to dissolve from its surface, and solid solution carbon quantity is calculated from weight ratio between C quantity and Fe quantity which are dissolved in a predetermined dissolving time, however, it may be estimated by measuring a depth of a specified structure of the steel which is determined (dependent on) by carburizing concentration.

Figure 12:
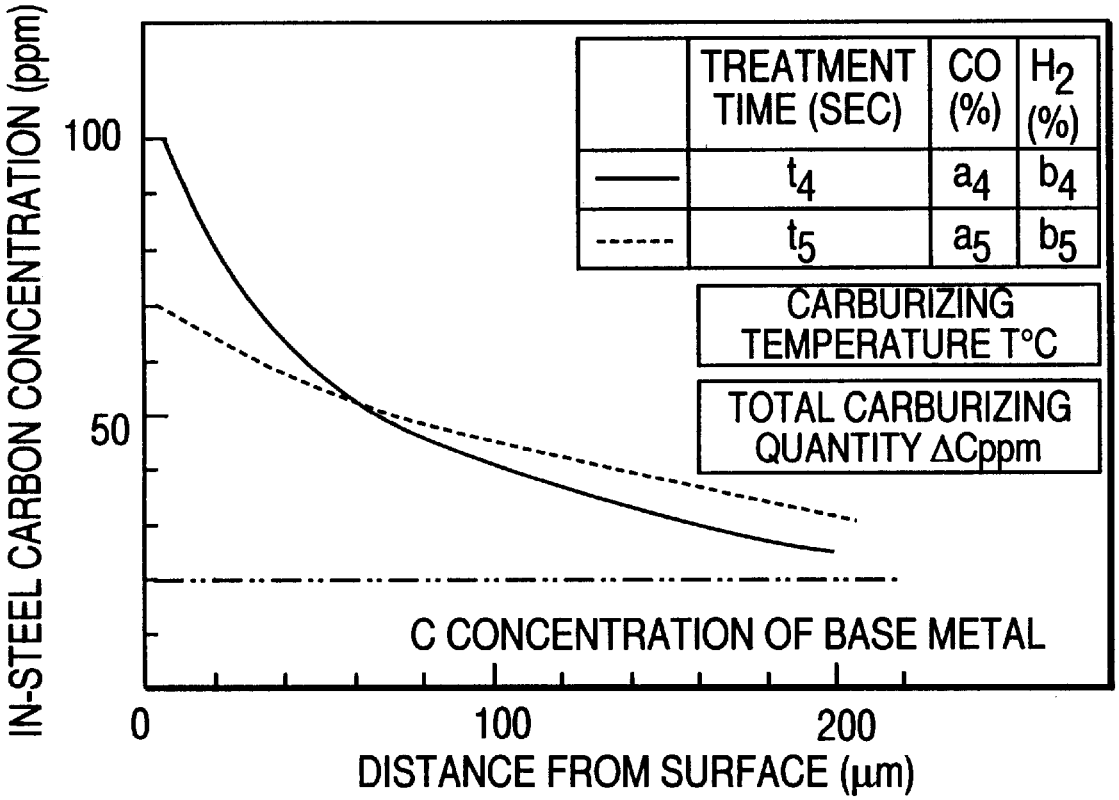
FIG. 12 is an explaining diagram of an example of a carburizing concentration distribution obtained in the case where an atmospheric gas composition concentration and a carburizing time are controlled by the algorithm of the embodiment of FIG. 6.
Figure 13:
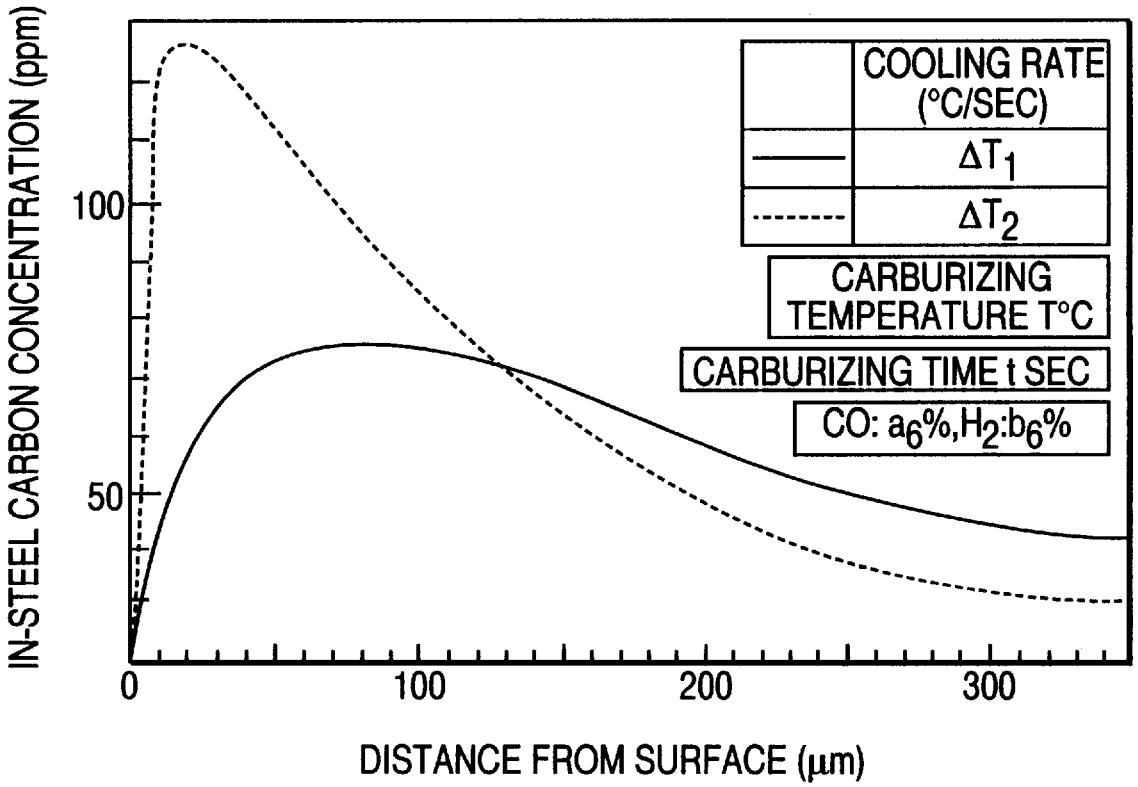
FIG. 13 is an explaining diagram of an example of a carburizing concentration distribution obtained in the case where a cooling rate after carburizing is controlled by the algorithm of the embodiment of FIG. 6.

Next, the results of experiments of the influence of the carburizing time in the in-steel diffusion model formula are shown in FIG. 12. In the figure, the experiments are conducted under the condition that the carburizing temperature T ° C. is constant, and the total carburizing quantity $\Delta C$ ppm is constant, and the solid line indicates the case wherein the carburizing is performed under the atmospheric condition that the CO concentration (%) is $a_4$, the H2 concentration (%) is $b_4$, and the carburizing time (treatment time, sec.) is $t_4$, and the broken line indicates the case wherein the carburizing is performed under the atmospheric condition that the CO concentration (%) is $a_5$, the $H_2$ concentration (%) is $b_5$, and the carburizing time (treatment time, sec.) is $t_5$. In this case, however, the carburizing time $t_5\neq 3t_4$, the CO concentration $a_4>a_5$, and the $H_2$ concentration $b_4>>b_5$. As described previously, the higher the CO concentration and the $H_2$ concentration, the larger becomes the carburizing reaction rate, and the longer the carburizing time, the larger becomes the carburizing quantity into the inner layer portion. Accordingly, as will be apparent from the figure, in the embodiment, when the gradient to the C concentration in the inner layer portion is to be made steep by increasing only the C concentration in the surface layer portion, it is only needed to decrease the carburizing time by increasing the carburizing reaction rate (enhancing the carburizing capability), and conversely, when the C concentration gradient between the inner layer portion and the surface layer portion is to be made gradual by increasing the whole C concentration in the steel plate, it is only needed to increase the carburizing time by decreasing the carburizing reaction rate (lowering the carburizing capability).

Next, an embodiment of controlling the carburizing concentration distribution by the plate temperature control after the carburizing process, specifically, by controlling the cooling rate will be explained by using FIG. 13. In the figure, under the condition that the carburizing temperature T ° C. constant, the carburizing time t sec. constant, the CO concentration $a_6$% constant, and the $H_2$ concentration $b_6$% constant, the solid line shows the case where the cooling is performed at a cooling rate of $\Delta T_1$° C./sec., and the broken line shows the case where the cooling is performed at a cooling rate of $\Delta T_2$° C./sec., and the cooling rates are in the following relation: $\Delta T_1<<\Delta T_2$. As will be apparent from the figure, since the diffusion of the solid solution C into the inside is fast suppressed as the cooling rate is larger, only the C concentration in the surface layer portion increases, and the gradient to the C concentration in the inner layer portion becomes steep. Conversely, when the cooling rate is smaller, since the solid solution C diffuses to the inside, the C concentration in the surface layer portion is low and the C concentration gradient to the inner layer portion becomes gradual.

In this embodiment, it is described as to the case where the strip which has been subjected to the predetermined carburizing treatment is rapidly cooled in the first cooling zone and the carbon diffusion is fixed. However, in the present invention, it is possible to manipulate the carbon diffusion state by heating, unformly heating, and cooling the strip after it is carburized. For this reason, in place of or in addition to the first cooling zone, a plate temperature control zone may be provided.

Furthermore, in this embodiment, it is described in detail as to the case wherein, by using the algorithm of FIG. 6, under the condition that the carburizing temperature is set from the material characteristic condition and the CO concentration and the $H_2$ concentration are set beforehand from the sooting generation limit, the carburizing time (plate-passing speed) is ultimately changed in order to obtain a predetermined C quantity; and as to the case wherein, by using the algorithm of FIG. 6, under the condition that the upper limits of the carburizing temperature and the carburizing time are set from the carburizing concentration distribution condition and the upper limits of the CO concentration and the $H_2$ concentration are set from the sooting generation limit, the carburizing time (plate-passing speed) and the atmospheric gas composition are ultimately changed in order to obtain a predetermined carburizing concentration distribution in the steel plate depth direction and a predetermined carburizing quantity; and as to the case wherein, by using the algorithm of FIG. 6, under the condition that the carburizing time is determined based on the plate-passing speed set from the operation condition other than the carburizing treatment and the carburizing temperature is set from the material characteristic condition, the atmospheric gas composition is ultimately changed in order to obtain a predetermined C quantity. However, including the above-mentioned cases, as a control example of each control factor mentioned above, the following control factors are also considered.

1) When the atmospheric composition is constant, the carburizing temperature and the carburizing time are changed individually or simultaneously.
2) When the carburizing temperature constant, the CO partial pressure or $H_2$ partial pressure or $CO+H_2$ partial pressure in the atmospheric composition, and the carburizing time are changed individually or simultaneously.
3) When the carburizing time is constant, the CO partial pressure or $H_2$ partial pressure or $CO+H_2$ partial pressure in the atmospheric composition, and the carburizing temperature are changed individually or simultaneously.
4) All the control factors are changed simultaneously or individually.

The method of selection of these control factors is not limited to any one of the above items, and all the items can be applied to any case.

Furthermore, in the embodiment, it is described in detail as to the case where the surface reaction rate is calculated taking into consideration the influence of CO, $H_2$, $CO_2$, and $H_2O$, however, as described in the foregoing, the surface reaction rate may be calculated by considering the influence of bi-carbon hydride.

Furthermore, in the embodiment, the equilibrium state is calculated by linearizing the thermodynamics model formula which takes into consideration the incomings and outgoings of materials, and by converging its solutions. However, the calculating means is not limited to the above means.

Furthermore, in the embodiment, it is described in detail only as to the case where in particular, in the surface reaction-governing area, the strip consisting of the extremely low carbon steel is continuously carburized and annealed, however, the embodiment is applicable to other carburizing reaction-governing area, or the case where only the carburizing is needed, or the other metal strips.

What is claimed is:

1. A method of continuously carburizing a metal strip comprising the steps of:

(a) preheating the metal strip;

(b) heating the metal strip in a heating zone following step (a), to a temperature of 700~950° C.;

(c) maintaining the metal strip heated in step (b) at the temperature of 700~950° C. in a uniform heating zone to form a congregated structure having a (1,1,1) organization;

(d) carburizing the metal strip in a carburizing heating zone at a furnace temperature of 700~950° C., in an atmosphere having a carbon monoxide concentration of $0\%<CO\leqq 22\%$ and hydrogen concentration of $0\%\leqq H_2\leqq 30\%$;

(e) rapidly cooling the metal strip in a first cooling zone to a temperature of 500~400° C. at a cooling speed of approximately 5° C./sec or higher; and (f) cooling the metal strip in a second cooling zone to a temperature of 250~200° C.

2. A method according to claim 1, wherein in step (d), the $H_2$ concentration in the atmosphere is selected to meet the expression:

$H_2$ concentration=$\alpha\cdot$(CO concentration), where $\alpha$ is a constant in the range of $0\leqq\alpha<5$, so that a carburizing reaction speed is based on a surface reaction speed.

3. A method of continuously carburizing a metal strip, within the carbon surface reaction rate governing basis, by using a host computer, comprising the steps of:

(a) inputting carburizing conditions including a target carburizing quantity ($\Delta C_0$), composition of atmospheric gas, a flow rate of supplied gas, a carburizing temperature and a strip-passing speed;

(b) setting a carburizing quantity ($\Delta C$) for introduction to the strip;

(c) calculating a carburizing quantity ($\Delta C'$) for introduction to the strip on the basis of the said carburizing conditions input in step (a);

(d) comparing the calculated carburizing quantity ($\Delta C'$) with the set carburizing quantity ($\Delta C$);

(e) outputting the composition of atmospheric gas, flow rate of supplied gas, carburizing temperature and the strip passing speed input in step (a) when the result of the comparison in step (d) indicates that the calculated carburizing quantity ($\Delta C'$) is approximately equal to the set carburizing quantity ($\Delta C$);

(f) controlling the carburizing conditions in a carburizing furnace of a continuous carburizing facility to correspond to the output composition of atmospheric gas, flow rate of supplied gas, carburizing temperature and the strip passing speed, if step (e) is performed;

(g) correcting the set carburizing quantity ($\Delta C$) to be introduced to the strip when the result of the comparison in step (d) indicates that a difference between the calculated carburizing quantity ($\Delta C'$) and the set carburizing quantity ($\Delta C$) is larger than a predetermined value;

(h) comparing the set carburizing quantity ($\Delta C$) corrected in step (g) with the target carburizing quantity ($\Delta C_0$), if step (g) is performed;

(i) correcting at least one carburizing condition selected from the group consisting of composition of atmospheric gas, carburizing temperature, and strip passing speed when the result of the comparison in step (h) indicates that a difference between the set carburizing quantity ($\Delta C$) corrected in step (g) and the target carburizing quantity ($\Delta C_0$) is larger than a predetermined value, if step (g) and (h) are performed;

(j) outputting the carburizing conditions corrected in step (i), if steps (g) through (i) are performed; and (k) controlling the carburizing conditions in the carburizing furnace in accordance with the carburizing conditions output in step (j), if steps (g) through (j) are performed.

4. A method of continuously carburizing a steel strip in a carburizing furnace while being passed through other heating zone for obtaining a desired carburizing quantity and carburizing concentration from the surface of steel strip, comprising the steps of:

(a) continuously passing the steel strip through a carburizing furnace;

(b) using a computer, calculating an atmospheric gas composition and the carburizing furnace temperature at which sooting is not generated, said calculation being based on a surface reaction rate of carbon at a surface of the steel strip and on a carbon balance in which the quantity per unit time of carbon in atmospheric gas supplied to the carburizing furnace is equal to the sum of the quantity per unit time of carbon brought out by the steel strip due to carburization and the quantity per unit time of carbon in the atmospheric gas which exits from the carburizing furnace; and (c) controlling the atmospheric gas composition and the furnace temperature within the carburizing furnace based on the atmospheric gas composition and furnace temperature calculated in step (b) within the basis of the surface reaction rate governing of carbon.

5. A method of continuously carburizing a steel strip according to claim 4, wherein at least one of the atmospheric gas composition and furnace temperature are calculated to achieve a carbon concentration in the steel strip which is equal to or less than an equilibrium concentration with the carbon concentration in the atmospheric gas.

6. A method of continuously carburizing a steel strip according to claim 4, wherein the atmospheric gas composition and furnace temperature are calculated in step (b) based on thermodynamics formulae which minimize Gibbs-free energy in the furnace and thereby to obtain an equilibrium state in the furnace.

7. A method of continuously carburizing a steel strip according to claim 6, wherein the atmospheric gas composition comprises carbon, oxygen and nitrogen.

8. A method of continuously carburizing a steel strip according to claim 6, wherein the atmospheric gas composition comprises carbon, oxygen, hydrogen and nitrogen.

9. A method of continuously carburizing a steel strip according to claim 8, wherein:

the atmospheric gas is calculated and controlled to have a carbon monoxide concentration of $0\% < CO$ concentration $\leqq 22\%$ and a hydrogen concentration of $0\% \leqq H_2$ concentration $\leqq 30\%$; and the furnace temperature is calculated and controlled to be within the range 700° C. to 950° C.

10. A method of continuously carburizing a steel strip within the carbon surface reaction rate governing basis, comprising the steps of:

(a) providing at least one formula selected from the group consisting of a first carburizing surface reaction rate formula based on a steel strip temperature and a carbon monoxide partial pressure, a second carburizing surface reaction rate formula based on the steel strip temperature, the carbon monoxide partial pressure and a hydrogen partial pressure and a formula for predicting a carburizing quantity based on a carburizing time;

(b) calculating steel strip temperature, atmospheric gas composition and carburizing time based on the at least one formula provided in step (a);

(c) supplying a carburizing gas into a carburizing furnace and plate-passing the steel strip through the carburizing furnace; and (d) controlling the steel strip temperature, atmospheric gas composition and carburizing time to the values calculated in step (b) to achieve reaction conditions where the carbon concentration in the steel strip is equal to or less than an equilibrium concentration with the carbon concentration in an atmospheric gas, and where a carburizing rate into the steel strip is greater than a diffusion rate within the steel strip.

11. A method of continuously carburizing a steel strip according to claim 10, wherein at least one of the first and second carburizing reaction rate formulas is provided in step (a) and is based on at least one of carbon dioxide partial pressure and water partial pressure.

12. A method of continuously carburizing a steel strip according to claim 10, wherein the carburizing time is calculated and controlled to correspond with a plate-passing speed, the plate-passing speed being restricted by an operating conditions other than.

13. A method of continuously carburizing a steel strip within the carbon surface reaction rate governing basis, comprising the steps of:

(a) providing a carbon diffusion model based on Fick's law and a surface reaction rate formula for calculating a desired carbon concentration in a thickness direction of the steel strip at at least one depth in the steel strip;

(b) calculating a suitable steel strip temperature, a suitable atmospheric gas composition and a carburizing time required for obtaining the desired carbon concentration at the at least one depth in the steel strip based on the carbon diffusion model provided in step (a);

(c) plate-passing the steel strip through a carburizing furnace supplied with a carburizing gas; and (d) controlling the steel strip temperature, atmospheric gas composition and carburizing time within the carburizing furnace based on the values calculated in step (b).

14. A method of continuously carburizing a steel strip according to claim 13, wherein a suitable carbon monoxide partial pressure and hydrogen partial pressure are calculated and controlled respectively in steps (b) and (d) when calculating and controlling the suitable atmospheric gas composition.

15. A method of continuously carburizing a steel strip according to claim 13, wherein a suitable carbon monoxide partial pressure, a suitable carbon dioxide partial pressure and water partial pressure are calculated and controlled respectively in steps (b) and (d) when calculating and controlling the suitable atmospheric gas composition.

16. A method of continuously carburizing a steel strip according to claim 13, wherein the desired carburizing concentration in step (a) is at at least one depth in a range of from 10 to 250 $\mu$m.

17. A method of continuously carburizing a steel strip according to claim 13, further comprising the step of (e) controlling the temperature of the steel strip after carburizing to thereby control the carbon concentration distribution in the thickness direction of the steel strip.

18. A method of continuously carburizing a steel strip comprising the steps of:

(a) calculating a total carburizing quantity (i) based on one of the following formula for determining a surface carburizing reaction rate (V) of carbon diffusing into a surface of the steel strip without reaching an equilibrium concentration with an atmospheric gas:

$$V = k_1 \cdot f_1(PCO, PH_2, \theta_0) \cdot \alpha \cdot f_3(PCO, PCO_2) \text{ and}$$

$$V = k_1 \cdot f_1(PCO, PH_2, \theta_0) - k_2 \cdot f_2(PCO_2, PH_2O),$$

where $\alpha$ is a constant, $k_1$ and $k_2$ are reaction rate constants, PCO, $PH_2$ and $PCO_2$ are respectively CO, $H_2$ and $CO_2$ partial pressures, and (ii) based on the following formula for in-steel carbon diffusion:

$$dC/dt=D\cdot d^2C/dX^2$$

where C is the carbon concentration in steel, t is time, D is a diffusion coefficient, and X is a diffusion distance;

(b) obtaining suitable ranges for a carburizing temperature, concentrations of CO, $H_2$, $CO_2$ and $H_2O$ in the atmospheric gas, and a carburizing time, for achieving the total carburizing quantity calculated in step (a);

(c) controlling said carburizing temperature, said concentrations of CO, $H_2$, $CO_2$, and $H_2O$, and said carburizing time in a carburizing furnace; and (d) passing the steel strip through the carburizing furnace.

19. A method of continuously carburizing a steel strip according to claim 18, wherein the total carburizing quantity calculated in step (a) is also (iii) based on a carburizing time which is determined by a plate-passing speed, the plate-passing speed being restricted by operating conditions other than carburizing; and suitable ranges for the carburizing temperature and concentrations of CO, $H_2$, $CO_2$ and $H_2O$ in the atmospheric gas are obtained in step (b) and controlled in step (c) with respect to the carburizing time which is determined by the plate-passing speed.

20. A method of continuously carburizing a steel strip according to claim 18 wherein the carburizing concentration is controlled to a concentration distribution in a range of depth of 10 to 250 $\mu$m.

21. A method of continuously carburizing a steel strip according to claim 18, further comprising the step of (e) after step (d), controlling the temperature of the steel strip to thereby control the carburizing concentration distribution in a thickness direction of the steel strip.

22. A method of continuously carburizing a steel strip comprising the steps of:

(a) calculating a total carburizing quantity (i) based on the following formula of a surface carburizing reaction rate (V) of carbon diffusing into a surface of the steel strip without reaching an equilibrium concentration with an atmospheric gas:

$$V=k_1\cdot f_1(PCO, PH_2, \theta_0)\cdot\alpha\cdot f_3(PCO, PCO_2) \text{ and}$$

$$V=k_1\cdot f_1(PCO, PH_2, \theta_0)-k_2\cdot f_2(PCO_2, PH_2O),$$

where $\alpha$ is a constant, $k_1$ and $k_2$ are reaction rate constants, PCO, $PH_2$ and $PCO_2$ are respectively CO, $H_2$ and $CO_2$ partial pressures, and (ii) based on the following formula for in-steel carbon diffusion:

$$dC/dt=D\cdot d^2C/dX^2$$

where C is the carbon concentration in steel, t is time, D is a diffusion coefficient, and X is a diffusion distance;

(b) obtaining suitable ranges for a carburizing temperature, concentrations of CO, $H_2$, $CO_2$ and $H_2O$ in the atmospheric gas, and a carburizing time, for achieving the total carburizing quantity calculated in step (a);

(c) obtaining a flow rate of atmospheric gas to be supplied to a carburizing furnace, the atmospheric gas having the suitable ranges obtained in step (b) for the concentrations of CO, $H_2$, $CO_2$ and $H_2O$, the flow rate and the concentrations of CO, $H_2$, $CO_2$ and $H_2O$ (i) satisfying a carbon balance in the furnace expressed by $W^g_I=W^s_c+W^g_o$, and $$W^s_c=\xi\ (V, t, w, LS)$$

where $W^g_I$ is the mass of carbon in the atmospheric gas entering the furnace, $W^s_c$ is the mass of carbon diffused into the steel strip and exiting the furnace in the steel strip, $W^g_o$ is the mass of carbon in the atmospheric gas exiting the furnace, V is the surface reaction rate used in step (a), t is the carburizing time, w is the width of the steel strip, and LS is the line speed of the steel strip, (ii) satisfying a requirement that free, condensed carbon is zero, and (iii) minimizing the Gibbs' free energy f(x) expressed by:

$$F(X)=\sum_{i-1}^{n} f_i^2 \sum_{h-1}^{p} f_h^c$$

where n is the number of kinds of gases and p is the number of kinds of condensations;

(d) in a carburizing furnace, controlling the carburizing temperature, and concentrations of CO, $H_2$, $CO_2$ and $H_2O$ to the ranges obtained in step (b) and controlling the flow rate of atmospheric gas to the rate obtained in step (c); and (e) passing the steel strip through the carburizing furnace.

23. A method of continuously carburizing a steel strip, comprising the steps of:

(a) inputting a target carburizing quantity ($\Delta C_O$), a composition of atmospheric gas, a flow rate of supplied gas, a carburizing temperature, a plate-passing speed, and a size of the steel strip;

(b) calculating a concentration of each component gas in the atmospheric gas, at which concentration sooting generation is prevented, Gibbs' total free energy (F(x)) is minimized and the quantity of carbon in the atmospheric gas supplied to the furnace is equal to the sum of the quantity of carbon brought out by the steel strip due to carburization and the quantity of carbon in the atmospheric gas which exists the carburizing furnace;

(c) calculating a surface reaction rate (V) per unit area by one of the following formulae under the premise that the carbon concentration in a surface layer of the steel strip is below an equilibrium concentration with the carbon concentration in the atmospheric gas:

$$V=k_1\cdot f_1(PCO, PH_2, \theta_0)\cdot\alpha\cdot f_3(PCO, PCO_2) \text{ and}$$

$$V=k_1\cdot f_1(PCO, PH_2, \theta_0)-k_2\cdot f_2(PCO_2, PH_2O),$$

where $\alpha$ is a constant, PCO, $PH_2$, $PCO_2$ and $PH_2O$ are respectively CO, $H_2$, $CO_2$ and $H_2O$ partial pressures, $\theta_0$ is the coating rate of the absorbed oxygen and $k_1$ and $k_2$ are reaction rate constants determined by the following formula:

$$k_i=A_i\cdot\exp(-E_i/RT)$$

where $A_i$ is a frequency factor, $E_i$ is the activation energy, R is the gas constant, and T is absolute temperature;

(d) calculating a carburizing quantity ($\Delta C'$) by integrating the surface reaction rate (V) per unit area with respect to a carburizing time and with respect to a total area of the steel strip;

(e) comparing the carburizing quantity ($\Delta C'$) calculated in step (d) with the target carburizing quantity ($\Delta C_0$) input in step (a), and changing at least one of the carburizing temperature, the plate-passing speed and the atmospheric gas composition, and repeating steps (b)–(d) to recalculate the concentration of each component gas, the surface reaction rate (V) the carburizing quantity ($\Delta C'$) when a difference between the calculated carburizing quantity ($\Delta C'$) and the target carburizing quantity ($\Delta C_0$) is greater than or equal to a predetermined value;

(f) outputting the carburization temperature, the plate-passing speed and the concentration of each component gas of the atmospheric gas when the difference between the calculated carburizing quantity ($\Delta C'$) and the target carburizing quantity ($\Delta C_0$) is less than the predetermined value; and (g) on the basis of the output in step (f), controlling a carburizing furnace temperature to 700~950° C., the carbon monoxide concentration to 0%<CO concentration≦22%, and the hydrogen concentration to 0%≦$H_2$ concentration≦30%; and (h) passing the steel strip through the carburizing furnace.

24. A method of continuously carburizing a steel strip, comprising the steps of:

(a) inputting a target carburizing quantity ($\Delta C_0$), a target carbon concentration ($C_1$) at a designated depth ($X_1$) from a surface of the steel strip, a composition of an atmospheric gas, a flow rate of the atmospheric gas, a carburizing temperature, a plate-passing speed, and a size of the steel strip plate;

(b) calculating a concentration of each component gas in an atmospheric gas system, at which concentration sooting generation is prevented, Gibbs' total free energy (F(x)) is minimized and the quantity of carbon in the atmospheric gas supplied to the furnace is equal to the sum of the quantity of carbon brought out by the steel strip due to carburization and the quantity of carbon in atmospheric gas which exists the carburizing furnace;

(c) calculating a diffusion rate per unit area (dC/dt) of solid carbon into the steel strip and obtaining a carbon diffusion quantity into the steel strip using the following formula:

$$dC/dt = D \cdot d^2C/dX^2$$

where C is the carbon concentration in the steel strip, t is time, D is a diffusion coefficient, and X is a diffusion distance;

(d) calculating a carburizing quantity ($\Delta C'$) by integrating the diffusion rate per unit area (dC/dt) with respect to a carburizing time and with respect to a total area of the steel strip;

(e) comparing the carburizing quantity ($\Delta C'$) calculated in step (d) with the target carburizing quantity ($\Delta C_0$) input in step (a), and changing at least one of the carburizing temperature, the plate-passing speed and the atmospheric gas composition, and repeating steps (b)–(d) to recalculate the concentration of each component gas, the diffusion rate per unit area (dC/dt) of solid carbon, and the carburizing quantity ($\Delta C'$) when a difference between the calculated carburizing quantity ($\Delta C'$) and the target carburizing quantity ($\Delta C_0$) is greater than or equal to a predetermined value;

(f) calculating a carbon concentration ($C'_1$) at the designated depth ($X_1$) from the surface of the steel plate by the formula $dC/dt = D \cdot d^2C/dX^2$ used in step (c), when the difference between the calculated carburizing quantity ($\Delta C'$) and the target carburizing quantity ($\Delta C_0$) is smaller than the predetermined value;

(g) comparing the carbon concentration ($C'_1$) at the designated depth ($X_1$) calculated in the step (f) with the target carbon concentration ($C_1$) at the designated depth ($X_1$) input in step (a), and changing at least one of the carburizing temperature, the plate-passing speed, and the atmospheric composition and repeating steps (b)–(f) when a difference between the calculated carbon concentration ($C'_1$) and the target C concentration ($C_1$) is greater than or equal to a predetermined value, and outputting the carburizing temperature, the plate-passing speed, the concentration of each component in the atmospheric gas, and the carburizing concentration to a depth of at least 10–250 μm below the surface of the steel strip when the difference is less than the predetermined value;

(h) on the basis of the output in step (g), controlling a carburizing furnace temperature to 700–950° C., the carbon monoxide concentration to 0% to 22%, and the hydrogen concentration to 0% to 30% and controlling the carburizing concentration to the output carburizing concentration to a depth of at least 10–250 μm; and (i) passing the steel strip through the carburizing furnace.

25. A method of continuously carburizing a steel strip according to claim 18, wherein the carburizing furnace is incorporated as a part of a continuous annealing furnace.

26. A method of continuously carburizing a steel strip according to claim 22, wherein the carburizing furnace is a continuous annealing furnace.

27. A method of continuously carburizing a steel strip according to claim 23, wherein the carburizing furnace is a continuous annealing furnace.

28. A method of continuously carburizing a steel strip according to claim 24, wherein the carburizing furnace is a continuous annealing furnace.

29. A method of continuously carburizing a steel strip according to claim 7, wherein:

the atmospheric gas is calculated and controlled to have a carbon monoxide concentration of 0%<CO concentration≦22%; and the furnace temperature is calculated and controlled to be within the range 700° C. to 950° C.

30. A method of continuously carburizing a steel strip according to claim 13, wherein a suitable carbon monoxide partial pressure is calculated and controlled respectively in steps (b) and (d) when calculating and controlling the suitable atmospheric gas composition.

31. A method of continuously carburizing a steel strip according to claim 13, wherein a suitable carbon monoxide partial pressure, suitable hydrogen partial pressure, suitable carbon dioxide partial pressure and water partial pressure are calculated and controlled respectively in steps (b) and (d) when calculating and controlling the suitable atmospheric gas composition.

32. A method of continuously carburizing a steel strip according to claim 12, wherein the plate-passing speed is restricted within a range by operating conditions other than carburizing, and the plate-passing speed is controlled within the range to optimize carburizing time.

33. A method of carburizing a steel strip, comprising the steps of:

(a) passing the steel strip through a carburizing furnace;

(b) determining a surface reaction rate of carbon at a surface of the steel strip;

(c) using calculations governed by the surface reaction rate of carbon at the surface of the steel strip, determining an atmospheric gas composition and a furnace temperature at which sooting is not generated; and (d) controlling the atmospheric gas composition and the furnace temperature within the carburizing furnace based on the atmospheric gas composition and furnace temperature determined in step (c).

* * * * *

UNITED STATES PATENT AND TRADEMARK OFFICE

CERTIFICATE OF CORRECTION

PATENT NO.: 6,074,493
DATED : June 13, 2000
INVENTOR(S): Nakagawa et al.

It is certified that errors appear in the above-identified patent and that said Letters Patent is hereby corrected as shown below:

Column 1,
line 27, change "no" to --not--. *

Column 2,
line 17, change "in-turnace" to --in-furnace--.

Column 3,
line 16, change "gaseus" to --gaseous--.

Column 11,
line 26, change "a so" to --and--; and
line 42, change "a nd" to --and--.

Column 13,
line 55, change "th is" to --this--.

Column 15,
line 43, change "SS21" to --S21--.

Column 25,
line 26, change "i n" to --in--.

Column 28,
line 7, change "500-400°" to --400-500°--; and
line 10, change "250-200°" to --200-250°--.*

UNITED STATES PATENT AND TRADEMARK OFFICE

CERTIFICATE OF CORRECTION

PATENT NO.: 6,074,493
DATED : June 13, 2000
INVENTOR(S): Nakagawa et al.

It is certified that errors appear in the above-identified patent and that said Letters Patent is hereby corrected as shown below:

Column 30,
line 19, change "than." to --than carburizing.--.

Column 33,
line 43, after "exists" insert --in--.*

Column 36,
line 19,

Signed and Sealed this

Fifteenth Day of May, 2001

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,074,493
DATED : June 13, 2000
INVENTOR(S) : Nakagawa et al.

It is certified that error appears in the above-identified patent and that said Letters Patent is hereby corrected as shown below:

Column 17,
Line 60, in equation (1), change "z" to --g-- and change "=" to --+--.

Column 32,
Line 23, in the equation, replace the current equation with the following:

$$F(X) = \sum_{i-1}^{n} f^{g}_{i} + \sum_{h-1}^{p} f^{c}_{h}$$

Signed and Sealed this

Twenty first Day of August, 2001

*Attest:*

Nicholas P. Godici

NICHOLAS P. GODICI
*Acting Director of the United States Patent and Trademark Office*

*Attesting Officer*